US007008048B2

(12) United States Patent
Sakaida

(10) Patent No.: US 7,008,048 B2
(45) Date of Patent: Mar. 7, 2006

(54) INK-JET HEAD AND INK-JET PRINTER HAVING INK-JET HEAD

(75) Inventor: Atsuo Sakaida, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/367,716

(22) Filed: Feb. 19, 2003

(65) Prior Publication Data

US 2003/0156165 A1 Aug. 21, 2003

(30) Foreign Application Priority Data

Feb. 19, 2002 (JP) ..... 2002-041312

(51) Int. Cl.
*B41J 2/045* (2006.01)

(52) U.S. Cl. ..... 347/68; 347/72

(58) Field of Classification Search ..... 347/68, 347/70–72; 29/25.35, 890.1
See application file for complete search history.

(56) References Cited

U.S. PATENT DOCUMENTS 4,680,595 A 7/1987 Cruz-Uribe et al.
5,087,930 A 2/1992 Roy et al.
5,402,159 A 3/1995 Takahashi et al.
5,757,400 A 5/1998 Hoisington
5,912,526 A * 6/1999 Okawa et al. ..... 310/328
6,331,045 B1 12/2001 Harvey et al. ..... 347/54

FOREIGN PATENT DOCUMENTS

EP 0 721 839 A2 7/1996
JP A 4-341852 11/1992
JP 9-323409 * 12/1997

OTHER PUBLICATIONS

Merriam Webster's Collegiate Dictionary, 1oth Ed., 1997, p. 1005.*

* cited by examiner

*Primary Examiner*—Stephen Meier
*Assistant Examiner*—An H. Do
(74) *Attorney, Agent, or Firm*—Oliff & Berridge, PLC

(57) ABSTRACT

An ink-jet head having a passage unit including pressure chambers each having one end coupled to a nozzle and the other end to be coupled to an ink supply source. The pressure chambers are arranged in a matrix adjacent to each other. The ink-jet head further includes an actuator unit attached to a surface of the passage unit for changing the volume of each of the pressure chambers. The actuator unit includes a piezoelectric sheet disposed to continuously extend over the pressure chambers, a common electrode disposed on one side of the piezoelectric sheet and kept at a constant potential, individual electrodes disposed on the other side of the piezoelectric sheet at positions corresponding to the respective pressure chambers, and recesses formed in regions of the piezoelectric sheet corresponding to portions between the pressure chambers.

17 Claims, 18 Drawing Sheets

INK-JET HEAD AND INK-JET PRINTER HAVING INK-JET HEAD

BACKGROUND OF THE INVENTION

1. Field of Invention

The invention relates to an ink-jet head for printing by ejecting ink onto an image recording medium, and to an ink-jet printer having the ink-jet head.

2. Description of Related Art

In an ink-jet printer, an ink-jet head distributes ink supplied from an ink tank to pressure chambers. The ink-jet head selectively applies pressure to each pressure chamber to eject ink through a nozzle. As a means for selectively applying pressure to the pressure chambers, an actuator unit having ceramic laminated piezoelectric sheets may be used.

As an example, a generally-known ink-jet head has one actuator unit in which continuous flat piezoelectric sheets extending over a plurality of pressure chambers are laminated. At least one of the piezoelectric sheets is sandwiched by a common electrode common to the pressure chambers and is kept at the ground potential. The actuator unit also includes and many individual electrodes, i.e., driving electrodes, disposed at positions corresponding to the respective pressure chambers. When an individual electrode on one face of the sheet is set at a different potential from the potential of the common electrode on the other face, the part of piezoelectric sheet being sandwiched by the individual and common electrodes, and which is polarized in its thickness, is expanded or contracted in its thickness direction, by the so-called longitudinal piezoelectric effect. In this case, the parts of the piezoelectric sheet sandwiched by the driving and common electrodes work as active layers(active portions) that are deformed by the piezoelectric effect when an external electric field is applied to them. The volumes of the corresponding pressure chambers thereby change, so ink can be ejected toward an image recording medium through nozzles communicating with the respective pressure chambers.

Recently, in an ink-jet head such as that described above, as the pressure chambers are disposed at a higher density in order to meet demands of increasing the image resolution and increasing the printing speed, a problem of crosstalk occurs. That is, when the active layer corresponding to a pressure chamber deforms, a portion of the piezoelectric sheet corresponding to another pressure chamber neighboring that pressure chamber can deform accordingly. As a result, ink is ejected through an ink ejection port that should not be used for ink ejection in this case, and the ink ejection amount may be more or less than the desired amount. When such crosstalk occurs, the quality of an image recording medium image may deteriorate. Therefore, to improve the quality of such an ink-jet printer, suppression of crosstalk is important.

SUMMARY OF THE INVENTION

An objective of the invention is to provide an ink-jet head capable of suppressing crosstalk occurrence, and an ink-jet printer having the ink-jet head.

The invention provides an ink-jet head comprising a passage unit that includes a plurality of pressure chambers, each pressure chamber having one end connected to a nozzle and the other end connectable to an ink supply source. The plurality of pressure chambers are arranged in a matrix to neighbor each other. The ink-jet head further comprises an actuator unit coupled to a surface of the passage unit for changing the volume of each of the pressure chambers. The actuator unit comprises a piezoelectric sheet disposed to continuously extend over the pressure chambers; a common electrode disposed on one side of the piezoelectric sheet and kept at a constant potential; individual electrodes disposed on the other side of the piezoelectric sheet at positions corresponding to the respective pressure chambers; and recesses formed in regions of the piezoelectric sheet corresponding to portions between the pressure chambers. The invention provides also an ink-jet printer having the ink-jet head.

By this structure, because a recess is formed in a region of the actuator unit corresponding to a portion between each neighboring pressure chambers, crosstalk can be suppressed in which deformation of an active layer by the piezoelectric effect may influence a neighboring pressure chamber.

BRIEF DESCRIPTION OF THE DRAWINGS

Other and further objects, features and advantages of the invention will become more apparent from the following description and the accompanying drawings, in which.

DETAILED DESCRIPTION OF PREFERRED EMBODIMENTS

Figure 1:
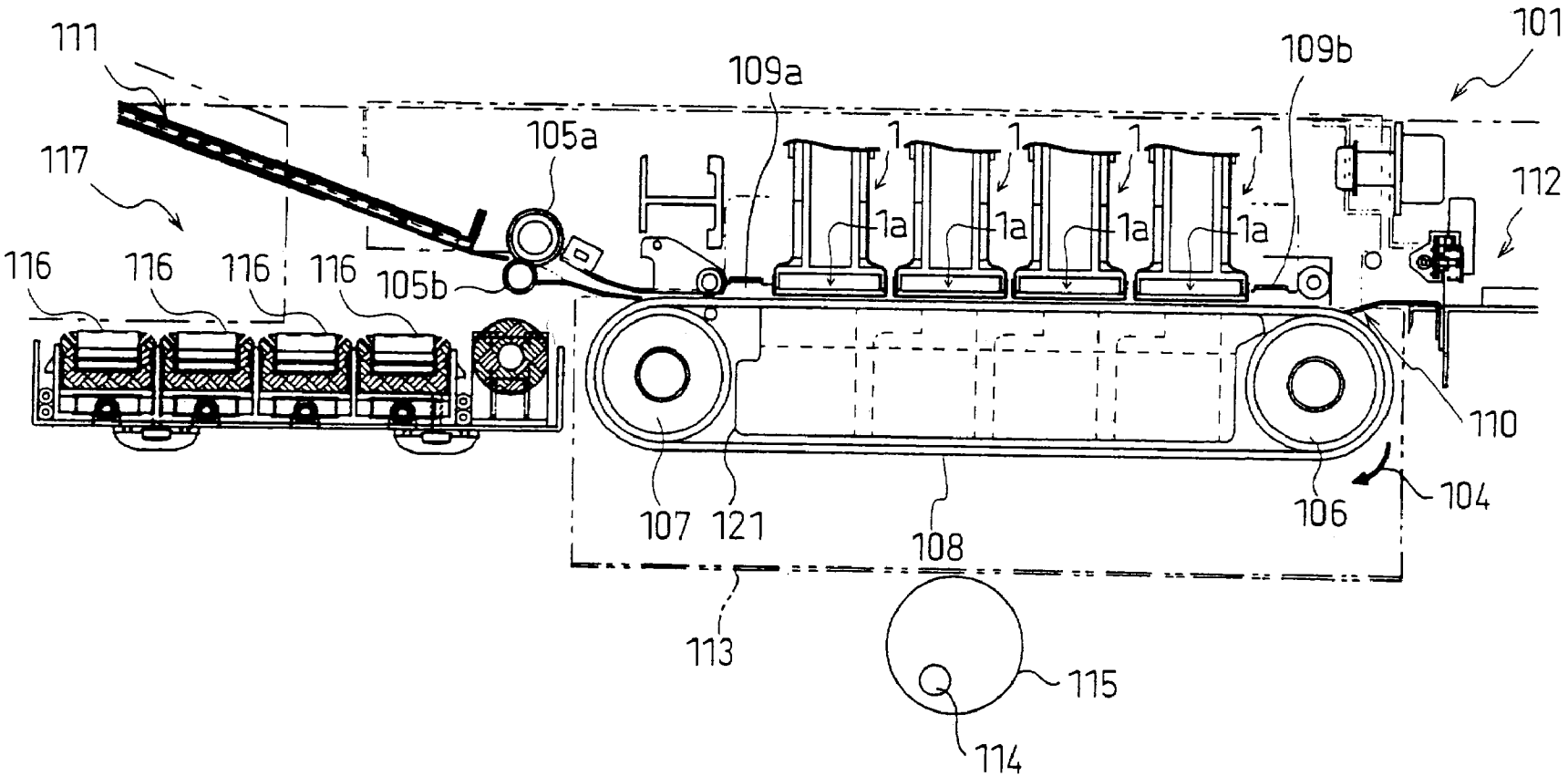
FIG. 1 is a general view of an ink-jet printer including ink-jet heads according to the first embodiment of the invention.

FIG. 1 is a schematic view of an ink-jet printer having ink-jet heads according to the first embodiment of the invention. As shown in FIG. 1, the ink-jet printer 101 is a color ink-jet printer having four ink-jet heads 1. In this exemplary embodiment, the printer 101 has an image recording medium feed unit 111 and an image recording medium discharge unit 112, which are disposed on the left and right portions printer 101 of FIG. 1, respectively. In various exemplary embodiments, the image recording medium includes, for example; a sheet of paper, card stock, photo paper, a transparency, or the like.

The ink-jet printer 101 includes an image recording medium transfer path that extends from the image recording medium feed unit 111 to the image recording medium discharge unit 112. A pair of feed rollers 105*a* and 105*b* is disposed immediately downstream of the image recording medium feed unit 111 for pinching and putting forward an image recording medium. By the pair of feed rollers 105*a* and 105*b*, the image recording medium is transferred from the left to the right of the printer 101 in FIG. 1. In the middle of the image recording medium transfer path, two belt rollers 106 and 107 and an endless transfer belt 108 are disposed. The transfer belt 108 is wound on the belt rollers 106 and 107 to extend between them. The outer face, i.e., the transfer face, of the transfer belt 108 has been treated with silicone. Thus, an image recording medium fed through the pair of feed rollers 105*a* and 105*b* can be held on the transfer face of the transfer belt 108 by the adhesion of the face. In this state, the image recording medium is transferred downstream (rightward) by driving one belt roller 106 to rotate clockwise in FIG. 1 (the direction indicated by an arrow 104).

The ink-jet printer 101 further includes pressing members 109*a* and 109*b*, which are disposed at positions for feeding an image recording medium onto the belt roller 107 and taking out the image recording medium from the belt roller 106, respectively. Either of the pressing members 109*a* and 109*b* can be used for pressing the image recording medium onto the transfer face of the transfer belt 108 so as to prevent the image recording medium from separating from the transfer face of the transfer belt 108. Thus, the image recording medium securely adheres to the transfer face.

A peeling device 110 is provided immediately downstream of the transfer belt 108 along the image recording medium transfer path. The peeling device 110 peels off the image recording medium, which has adhered to the transfer face of the transfer belt 108, from the transfer face to transfer the image recording medium toward the rightward image recording medium discharge unit 112.

Each of the four ink-jet heads 1 includes at its lower end a head main body 1*a*. Each head main body 1*a* has a rectangular section. The head main bodies 1*a* are arranged close to each other, with the longitudinal axis of each head main body 1*a* being perpendicular to the image recording medium transfer direction (perpendicular to FIG. 1). That is, this printer 101 is a line type. The bottom of each of the four head main bodies 1*a* faces the image recording medium transfer path. In the bottom portion of each head main body 1*a*, a number of nozzles are provided, each nozzle having a small-diameter ink ejection port. The four head main bodies 1*a* eject ink of magenta, yellow, cyan, and black, respectively. However, various other embodiments of the invention are not limited by the above described colors or order.

The head main bodies 1*a* are disposed such that a narrow clearance must be formed between the lower face of each head main body 1*a* and the transfer face of the transfer belt 108. The image recording medium transfer path is formed within the clearance. In this structure, while an image recording medium which is being transferred by the transfer belt 108, passes immediately below each of the four head main bodies 1*a*, the respective color inks are ejected through the corresponding nozzles toward the upper face, i.e., the print face, of the image recording medium to form a desired color image on the image recording medium.

The ink-jet printer 101 is provided with a maintenance unit 117 for automatically carrying out maintenance of the ink-jet heads 1. The maintenance unit 117 includes four caps 116 for covering the lower faces of the four head main bodies 1*a*, and a purge system (not shown).

During ink-jet printer 101 operation, the maintenance unit 117 is at a position immediately below the image recording medium feed unit 117 (withdrawal position). When a predetermined condition is satisfied after finishing the printing operation, for example, when no printing operation takes place for a predetermined time period or when the printer 101 is powered off, the maintenance unit 117 moves to a position, e.g., cap position, immediately below the four head main bodies 1*a*. At this cap position, the maintenance unit 117 covers the lower faces of the head main bodies 1*a* with the respective caps 116 to prevent ink in the nozzles of the head main bodies 1*a* from getting dry.

The belt rollers 106 and 107 and the transfer belt 108 are supported by a chassis 113. The chassis 113 is put on a cylindrical member 115 disposed under the chassis 113. The cylindrical member 115 is rotatable around a shaft 114 provided at a position which is off center from the center of the cylindrical member 115. Thus, by rotating the shaft 114, the level of the uppermost portion of the cylindrical member 115 can be changed to move up or down the chassis 113 accordingly. When the maintenance unit 117 is moved from the withdrawal position to the cap position, the cylindrical member 115 must have been rotated at a predetermined angle in advance so as to move down the transfer belt 108 and the belt rollers 106 and 107 by an applicable distance from the position shown in FIG. 1. A space for the movement of the maintenance unit 117 is thereby ensured.

In the region surrounded by the transfer belt 108, a nearly rectangular guide 121 (having its width substantially equal to that of the transfer belt 108) is disposed at an opposite position to the ink-jet heads 1. The guide 121 is in contact with the lower face of the upper part of the transfer belt 108 to support the upper part of the transfer belt 108 from the inside.

Figure 2:
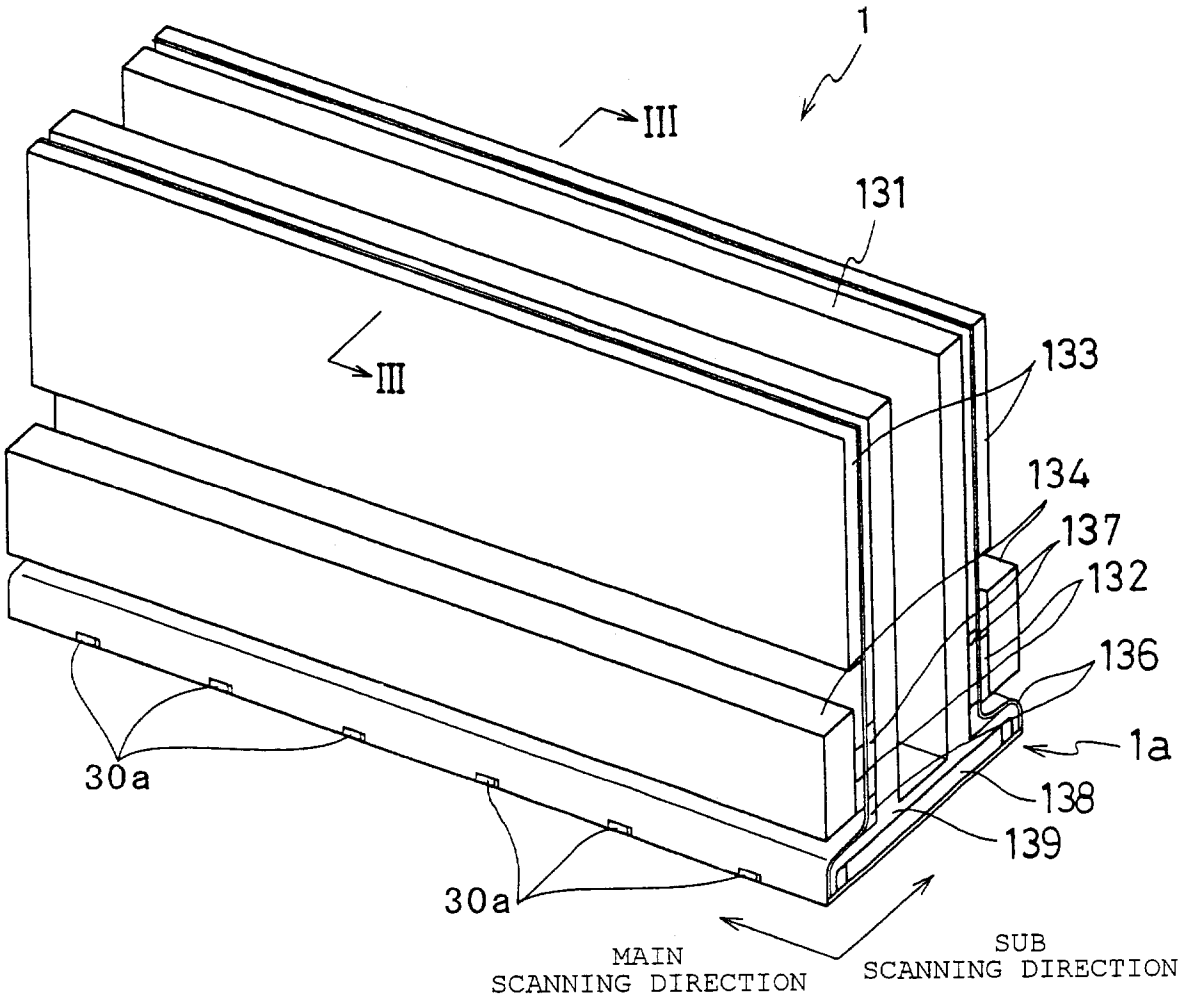
FIG. 2 is a perspective view of the ink-jet head according to the first embodiment of the present invention.
Figure 3:
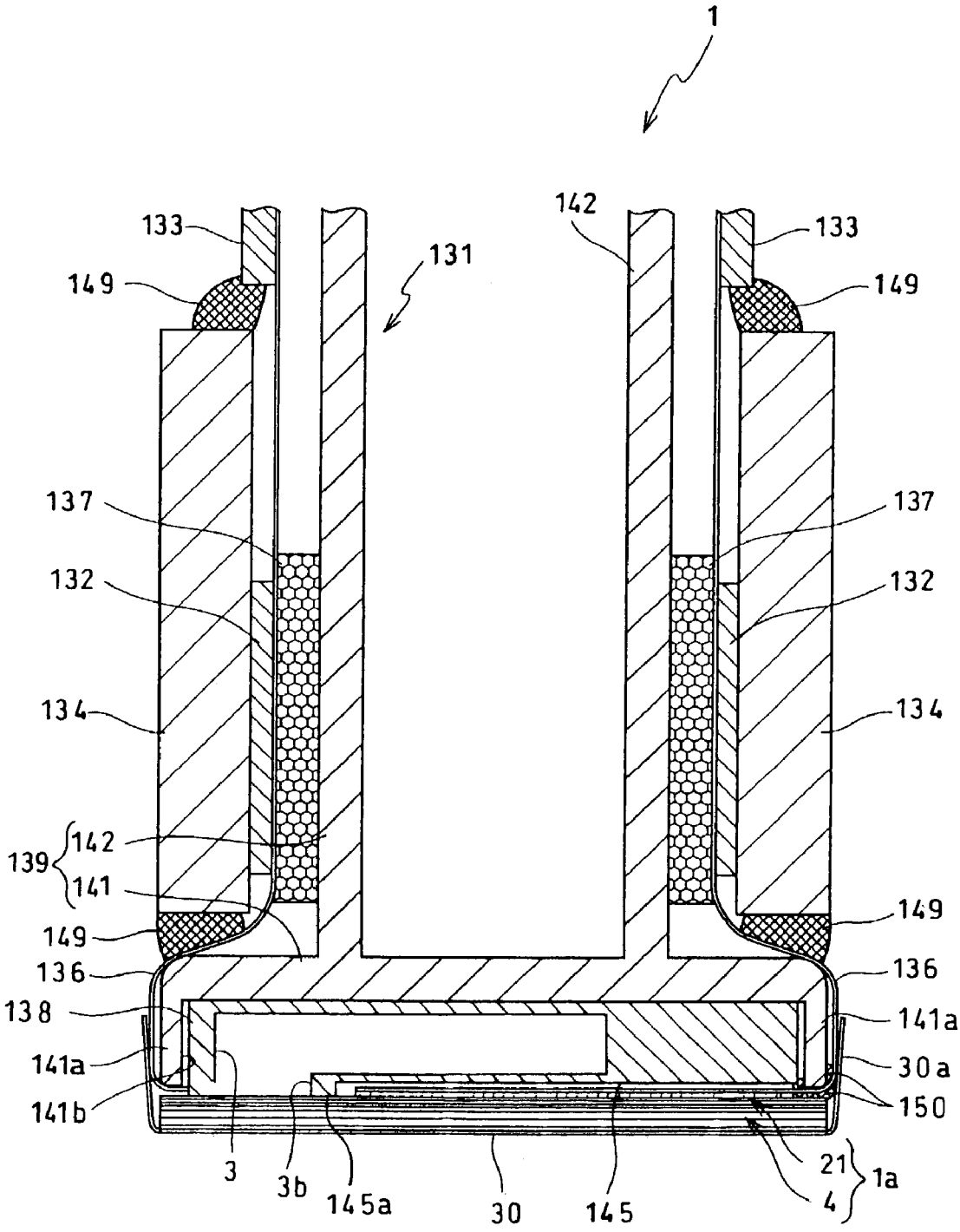
FIG. 3 is a sectional view taken along line III—III in FIG. 2.

Next, the structure of each ink-jet head 1 according to this exemplary embodiment will be described in more detail. FIG. 2 is a perspective view of the ink-jet head 1. FIG. 3 is a sectional view taken along line III—III in FIG. 2. Referring to FIGS. 2 and 3, the ink-jet head 1 according to this embodiment includes a head main body 1*a* having a rectangular shape in a plan view with its longest side extending in the main scanning direction, and a base portion 131 for supporting the head main body 1*a*. The base portion 131 supporting the head main body 1*a* further supports thereon driver ICs 132 for supplying driving signals to individual electrodes 35 (see FIG. 6), and substrates 133.

Referring to FIG. 2, the base portion 131 includes a base block 138 partially bonded to the upper face of the head main body 1*a* to support the head main body 1*a*, and a holder 139 bonded to the upper face of the base block 138 to support the base block 138. The base block 138 is a nearly rectangular member having substantially the same length of the head main body 1*a*. The base block 138 is made of a metal type material, such as stainless steel, and functions as a light structure for reinforcing the holder 139. The holder 139 includes a holder main body 141 disposed near the head main body 1*a*, and a pair of holder support portions 142, each of which extend on the opposite side of the holder main body 141 to the head main body 1*a*. Each holder support portion 142 is configured as a flat member. These holder support portions 142 extend along the longitudinal direction of the holder main body 141 and are disposed in parallel with each other at a predetermined interval.

Skirt portions 141*a* in a pair, protruding downward, are provided in both end portions of the holder main body 141*a* in a direction perpendicular to the main scanning direction. Each skirt portion 141*a* is formed through the length of the holder main body 141. As a result, a nearly rectangular groove 141*b* is defined by the pair of skirt portions 141*a* in the lower portion of the holder main body 141. The base block 138 is positioned in the groove 141*b*. The upper surface of the base block 138 is adhered to the bottom of the groove 141*b* of the holder main body 141 with an adhesive. The thickness of the base block 138 is slightly larger than the depth of the groove 141*b* of the holder main body 141. As a result, the lower end of the base block 138 protrudes downward beyond the skirt portions 141*a*.

Within the base block 138, as a passage for ink to be supplied to the head main body 1*a*, an ink reservoir 3 is formed as a nearly rectangular space or hollow region extending along the longitudinal direction of the base block 138. In the lower face 145 of the base block 138, openings 3*b* (see FIG. 4) are formed each communicating with the ink reservoir 3. The ink reservoir 3 is connected with a main ink tank or ink supply source (not shown) within the printer main body through a supply tube. Thus, the ink reservoir 3 is appropriately supplied with ink from the main ink tank.

In the lower face 145 of the base block 138, the surrounding area of each opening 3*b* protrudes downward from the surrounding portion. The base block 138 is fixed to a passage unit 4 (see FIG. 3) of the head main body 1*a* at the only vicinity portion 145*a* of each opening 3*b* of the lower face 145. Thus, the region of the lower face 145 of the base block 138 other than the vicinity portion 145*a* of each opening 3*b* is distant from the head main body 1*a*. Actuator units 21 are disposed within the distance.

On the outer side face of each holder support portion 142 of the holder 139, a driver IC 132 is attached with an elastic member 137, such as a sponge, positioned between them. A heat sink 134 is disposed in close contact with the outer side face of the driver IC 132. The heat sink 134 is made of a nearly rectangular member for efficiently radiating heat generated in the driver IC 132. A flexible printed circuit (FPC) 136 acting as a power supply member, is connected to the driver IC 132. The FPC 136 coupled to the driver IC 132 is bonded to, and electrically-connected with, the corresponding substrate 133 and the head main body 1*a* using solder or the like. The substrate 133 is disposed outside the FPC 136 above the driver IC 132 and the heat sink 134. The upper face of the heat sink 134 is bonded to the substrate 133 with a seal member 149. Also, the lower face of the heat sink 134 is bonded to the FPC 136 with a seal member 149.

Between the lower face of each skirt portion 141*a* of the holder main body 141 and the upper face of the passage unit 4, a seal member 150 is disposed to sandwich the FPC 136. The FPC 136 is attached to the passage unit 4 and the holder main body 141 using the seal member 150. Therefore, even if the head main body 1*a* is elongated, the head main body 1*a* can be prevented from bending, the interconnecting portion between each actuator unit and the FPC 136 can be prevented from receiving stress, and the FPC 136 can be securely held in place.

Referring to FIG. 2, near each lower corner of the ink-jet head 1 along the main scanning direction, six protruding portions 30*a* are disposed at regular intervals along the corresponding side wall of the ink-jet head 1. These protruding portions 30*a* are provided at both ends in the sub scanning direction of a nozzle plate 30 in the lowermost layer of the head main body 1*a* (see FIGS. 7A and 7B). The nozzle plate 30 is bent by about 90 degrees along the boundary line between each protruding portion 30*a* and the other portion. The protruding portions 30*a* are provided at positions corresponding to the vicinities of both ends of various image recording mediums to be used for printing. Each bent portion of the nozzle plate 30 has a rounded shape. This makes it difficult for an image recording medium to jam.

Figure 4:
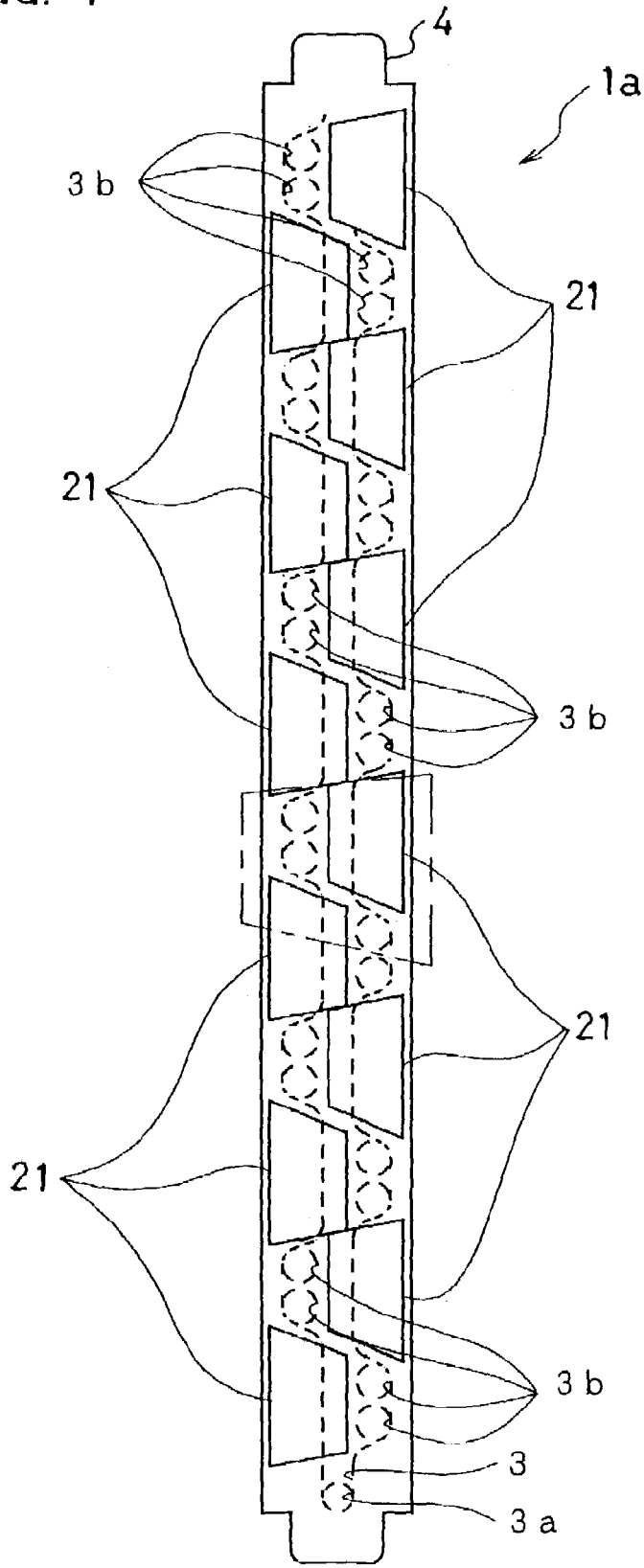
FIG. 4 is a plan view of a ink-jet head main body included in the ink-jet head of FIG. 2.

FIG. 4 is a schematic plan view of the head main body 1*a*. In FIG. 4, an ink reservoir 3 formed in the base block 138 is conceptually shown with a broken line. Referring to FIG. 4, the head main body 1*a* has a rectangular shape in the plan view extending in the main scanning direction. The head main body 1*a* includes a passage unit 4, in which a large number of pressure chambers 10 and a large number of ink ejection ports 8 at the front ends of nozzles (as for both, see FIGS. 5, 6, and 7), are provided as described later. Trapezoidal actuator units 21 arranged in two lines in a zigzag manner are bonded onto the upper face of the passage unit 4. Each actuator unit 21 is disposed such that its parallel opposed sides (upper and lower sides) extend along the longitudinal direction of the passage unit 4. The oblique sides of each neighboring actuator units 21 overlap each other in the lateral direction of the passage unit 4.

The lower face of the passage unit 4 corresponding to the bonded region of each actuator unit 4 is made into an ink ejection region. In the surface of each ink ejection region, a large number of ink ejection ports 8 are arranged in a matrix, as described later. In the base block 138 disposed above the passage unit 4, an ink reservoir 3 is formed along the longitudinal direction of the base block 138. The ink reservoir 3 communicates with an ink tank (not shown) through an opening 3*a* provided at one end of the ink reservoir 3, so that the ink reservoir 3 is always filled up with ink. In the ink reservoir 3, pairs of openings 3*b* are provided in regions where no actuator unit 21 is present, so as to be arranged in a crisscross manner along the longitudinal direction of the ink reservoir 3.

Figure 5:
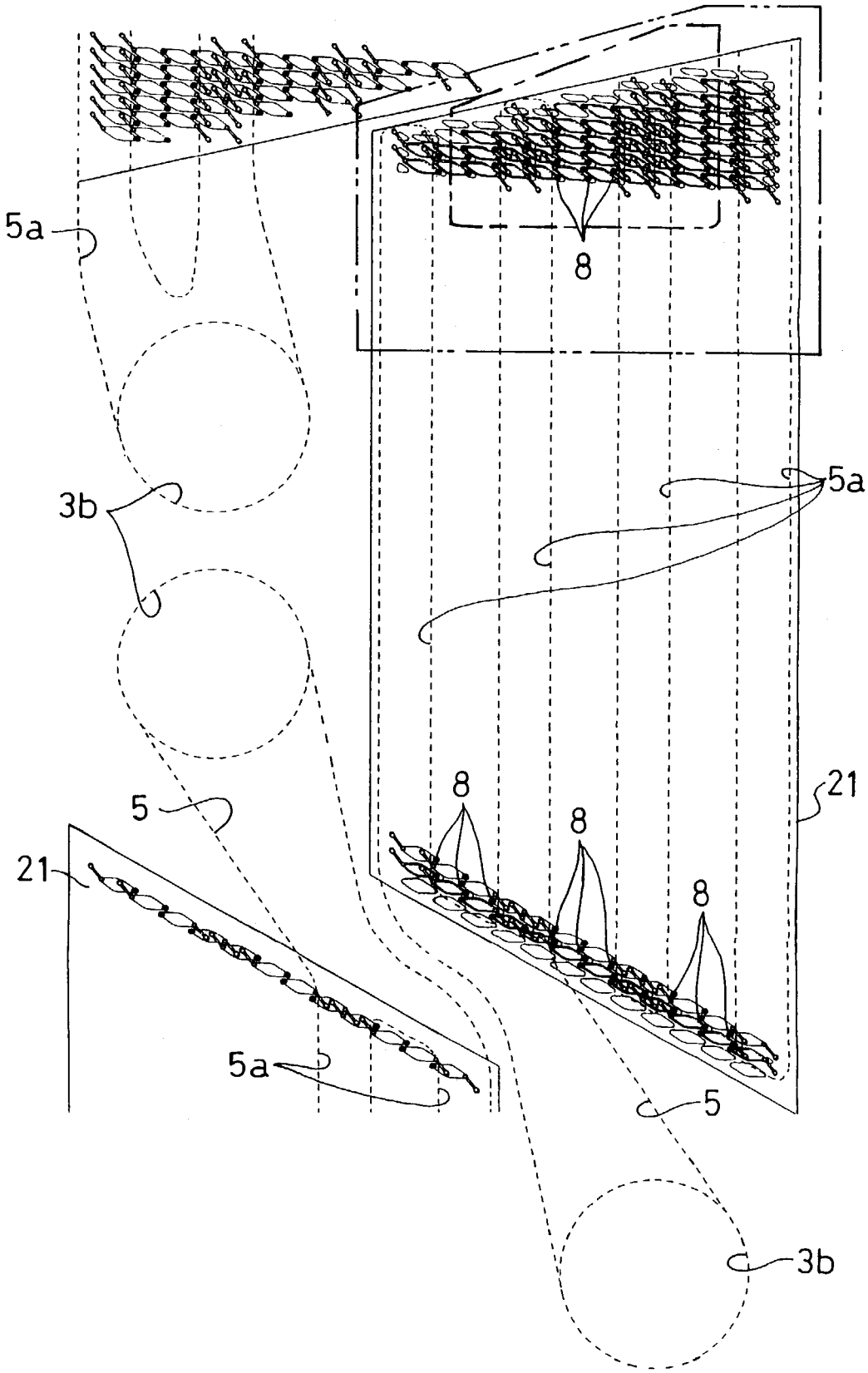
FIG. 5 is an enlarged view of the region enclosed with an alternate long and short dash line in FIG. 4.

FIG. 5 is an enlarged view of the region enclosed with an alternate long and short dash line in FIG. 4. Referring to FIGS. 4 and 5, the ink reservoir 3 communicates through openings 3*b* with a manifold channel 5 disposed under the opening 3*b*. Each opening 3*b* is provided with a filter (not shown) for catching dust and dirt that may be present in ink. The front end portion of each manifold channel 5 branches into two sub-manifold channels 5*a*. Below a single one of the actuator unit 21, two sub-manifold channels 5*a* extend from each of the two openings 3*b* on both sides of the actuator unit 21 in the longitudinal direction of the ink-jet head 1. That is, below the single actuator unit 21, four sub-manifold channels 5*a* in total extend along the longitudinal direction of the ink-jet head 1. Each sub-manifold channel 5*a* is filled up with ink supplied from the ink reservoir 3.

Figure 6:
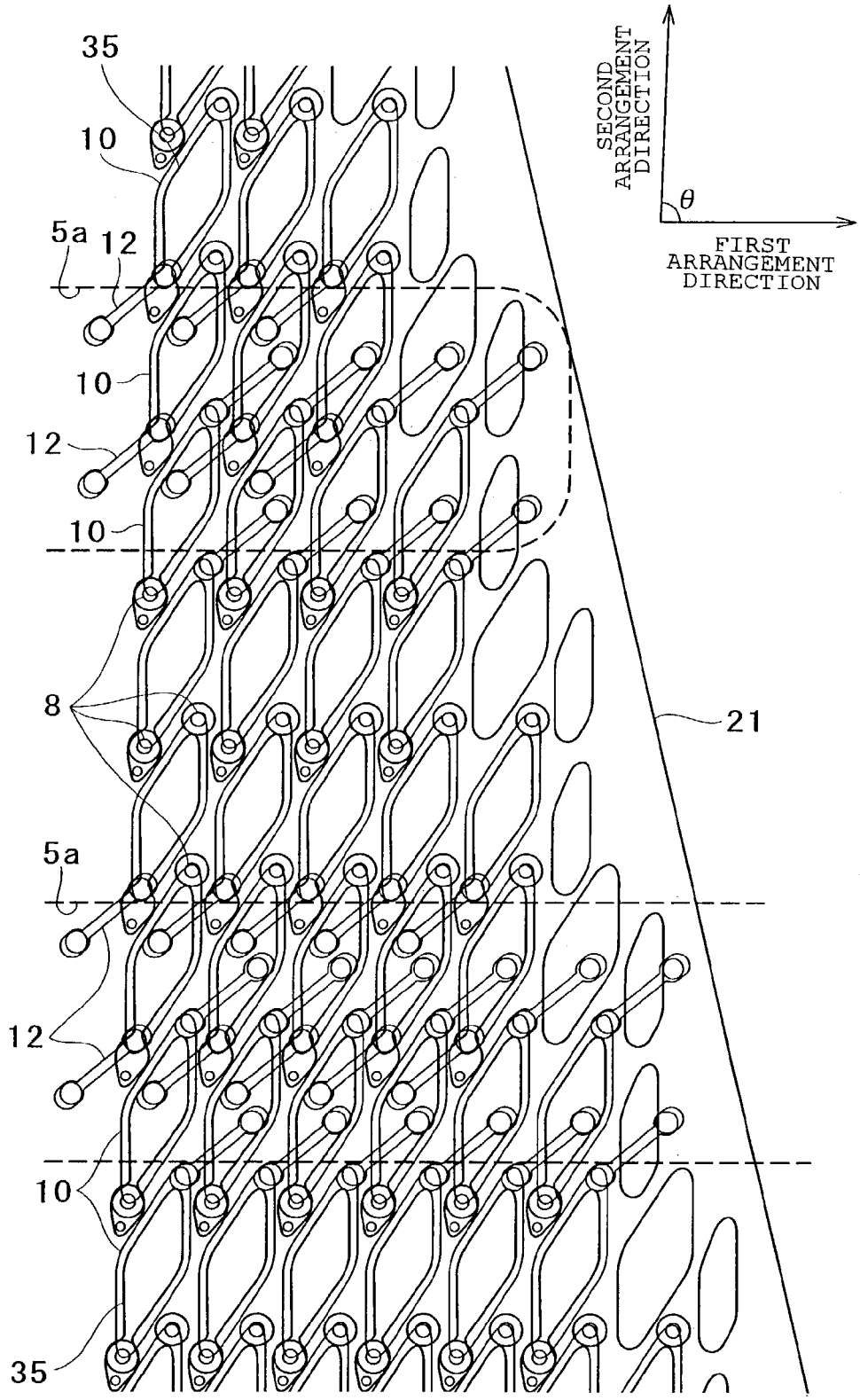
FIG. 6 is an enlarged view of the region enclosed with an alternate long and short dash line in FIG. 5.

FIG. 6 is an enlarged view of the region enclosed with an alternate long and short dash line in FIG. 5. Referring to FIGS. 5 and 6, on the upper face of each actuator unit 21, individual electrodes 35 each having a nearly diamond or rhombic shape in a plan view, are uniformly arranged in a matrix. A large number of ink ejection ports 8 are arranged in a matrix in the surface of the ink ejection region corresponding to the actuator unit 21 of the passage unit 4. In the passage unit 4, pressure chambers (cavities) 10 each having a nearly rhombic shape in a plan view somewhat larger than that of the individual electrodes 35 are uniformly arranged in a matrix. Further in the passage unit 4, apertures 12 are also uniformly arranged in a matrix. These pressure chambers 10 and apertures 12 communicate with the corresponding ink ejection ports 8. The pressure chambers 10 are provided at positions corresponding to the respective individual electrodes 35. In a plan view, the large part of the individual electrode 35*a* and 35*b* is included in a region of the corresponding pressure chamber 10. In FIGS. 5 and 6, for ease in understanding the drawings, the pressure chambers 10, the apertures 12, etc., are shown with solid lines though they should be shown with broken lines because they are within the actuator unit 21 or the passage unit 4. Further, in FIGS. 5 and 6, grooves 61, which will be described later, are not shown.

Figure 7:
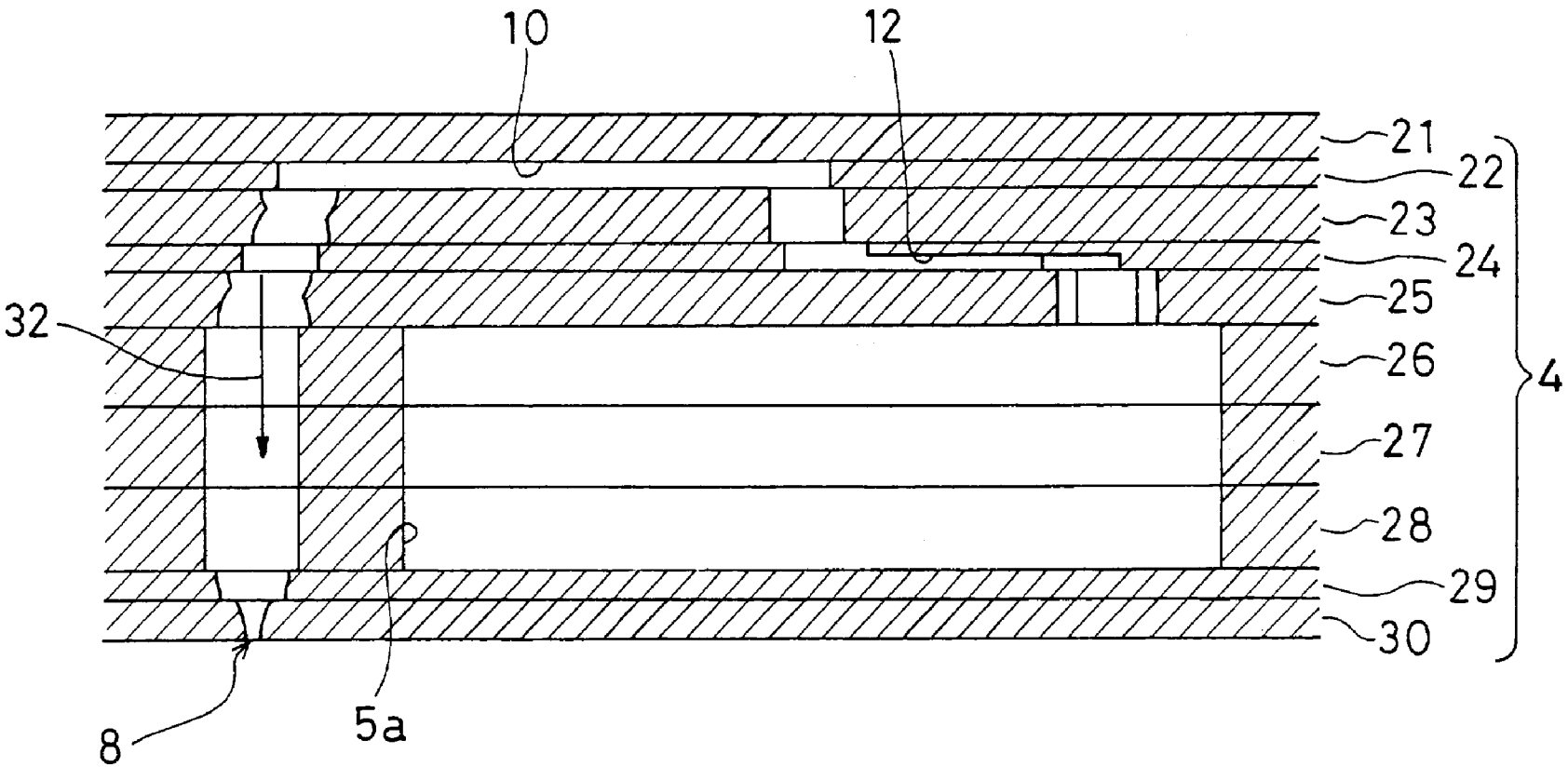
FIG. 7 is a partial sectional view of the ink-jet head main body of FIG. 4.

FIG. 7 is a partial sectional view of the head main body 1*a* of FIG. 4 along the longitudinal direction of a pressure chamber. As shown in FIG. 7, each ink ejection port 8 is formed at the front end of a tapered nozzle. Each ink ejection port 8 communicates with a sub-manifold channel 5*a* through a pressure chamber 10 (length: 900 microns, width: 350 microns) and an aperture 12. Thus, within the ink-jet head 1 formed are ink passages 32 each extending from an ink tank to an ink ejection port 8 through an ink reservoir 3, a manifold channel 5, a sub-manifold channel 5*a*, an aperture 12, and a pressure chamber 10.

Referring to FIG. 7, the pressure chamber 10 and the aperture 12 are provided at different levels. Therefore, in the portion of the passage unit 4 corresponding to the ink ejection region under an actuator unit 21, an aperture 12 communicating with one pressure chamber 10 can be disposed within the same portion in plan view as a pressure chamber 10 neighboring the pressure chamber 10 communicating with the aperture 12. As a result, because pressure chambers 10 can be arranged close to each other at a high density, high resolution image printing can be achieved with an ink-jet head 1 having a relatively small occupation area.

In the plane of FIGS. 5 and 6, pressure chambers 10 are arranged within an ink ejection region in two directions, that is, a direction along the longitudinal direction of the ink-jet head 1, called a first arrangement direction, and a direction somewhat inclining from the lateral direction of the ink-jet head 1, called a second arrangement direction. The first and second arrangement directions form an angle theta, θ, somewhat smaller than the right angle. The second arrangement direction is along the lower left or upper right side of each pressure chamber 10 shown in FIG. 6. The ink ejection ports 8 are arranged at 50 dpi in the first arrangement direction. On the other hand, the pressure chambers 10 are arranged in the second arrangement direction such that the ink ejection region corresponding to one actuator unit 21 includes twelve pressure chambers 10. Therefore, within the whole width of the ink-jet head 1, in a region of the interval between two ink ejection ports 8 neighboring each other in the first arrangement direction, there are twelve ink ejection ports 8. At both ends of each ink ejection region in the first arrangement direction (corresponding to an oblique side of the actuator unit 21), the above condition is satisfied by making a compensation relation to the ink ejection region corresponding to the opposite actuator unit 21 in the lateral direction of the ink-jet head 1. Therefore, in the ink-jet head 1 according to this embodiment, by ejecting ink droplets in order through a large number of ink ejection ports 8 arranged in the first and second directions with relative movement of an image recording medium along the lateral direction of the ink-jet head 1, printing at 600 dpi in the main scanning direction can be performed.

Figure 8:
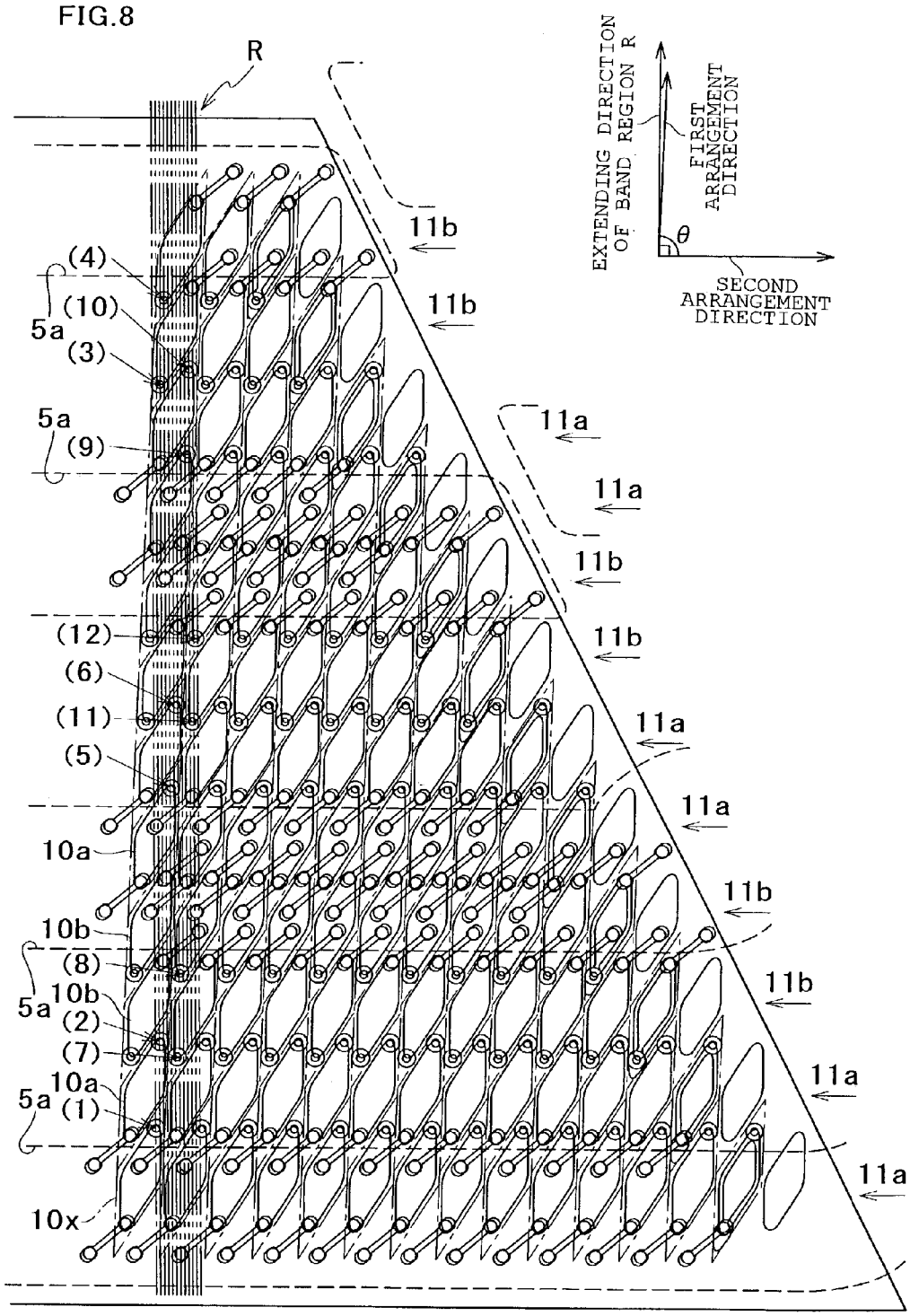
FIG. 8 is an enlarged view of the region enclosed with an alternate long and two short dashes line in FIG. 5.

Next, the structure of the passage unit 4 will be described in more detail with reference to FIG. 8. FIG. 8 is a schematic view showing the positional relation among each pressure chamber 10, each ink ejection port 8, and each aperture restricted passage, 12. Referring to FIG. 8, pressure chambers 10 are arranged in lines in the first arrangement direction at predetermined intervals at 50 dpi. Twelve lines of pressure chambers 10 are arranged in the second arrangement direction. As the whole, the pressure chambers 10 are two-dimensionally arranged in the ink ejection region corresponding to one actuator unit 21.

The pressure chambers 10 are classified into two types: pressure chambers 10*a*, in each of which a nozzle is connected with the upper acute portion in FIG. 8, and pressure chambers 10*b*, in each of which a nozzle is connected with the lower acute portion. Pressure chambers 10*a* and 10*b* are arranged in the first arrangement direction to form pressure chamber lines 11*a* and 11*b*, respectively. Referring to FIG. 8, in the ink ejection region corresponding to one actuator unit 21, from the lower side of FIG. 8, there are disposed two pressure chamber lines 11*a* and two pressure chamber lines 11*b* neighboring the upper side of the pressure chamber lines 11*a*. The four pressure chamber lines of the two pressure chamber lines 11*a* and the two pressure chamber lines 11*b* constitute a set of pressure chamber lines. Such a set of pressure chamber lines is repeatedly disposed three times from the lower side in the ink ejection region corresponding to one actuator unit 21. A straight line extending through the upper acute portion of each pressure chamber in each pressure chamber lines 11*a* and 11*b* crosses the lower oblique side of each pressure chamber in the pressure chamber line neighboring the upper side of that pressure chamber line.

As described above, when viewing perpendicularly to FIG. 8, two first pressure chamber lines 11*a* and two pressure chamber lines 11*b*, in which nozzles connected with pressure chambers 10 are disposed at different positions, are arranged alternately close to each other. Consequently, as an entire structure, the pressure chambers 10 are arranged in a uniform like pattern. On the other hand, nozzles are arranged in a concentrated manner in a central region of each set of pressure chamber lines formed by the above four pressure chamber lines. Therefore, in case that each four pressure chamber lines forms a set of pressure chamber lines and such a set of pressure chamber lines is repeatedly disposed three times from the lower side as described above, a region where no nozzle exists is formed near the boundary between each neighboring sets of pressure chamber lines, i.e., on both sides of each set of pressure chamber lines constituted by four pressure chamber lines. Wide sub-manifold channels 5*a* for supplying ink to the corresponding pressure chambers 10 extend there. In this embodiment, in the ink ejection region corresponding to one actuator unit 21, four wide sub-manifold channels 5*a* in total are arranged in the first arrangement direction, i.e., one on the lower side of FIG. 8, one between the lowermost set of pressure chamber lines and the second lowermost set of pressure chamber lines, and two on both sides of the uppermost set of pressure chamber lines.

Referring to FIG. 8, nozzles communicating with ink ejection ports 8 for ejecting ink are arranged in the first arrangement direction at regular intervals at 50 dpi to correspond to the respective pressure chambers 10 uniformly arranged in the first arrangement direction. On the other hand, while twelve pressure chambers 10 are uniformly arranged also in the second arrangement direction forming an angle theta θ with the first arrangement direction, twelve nozzles corresponding to the twelve pressure chambers 10 include ones each communicating with the upper acute portion of the corresponding pressure chamber 10 and ones each communicating with the lower acute portion of the corresponding pressure chamber 10, as a result, they are not uniformly arranged in the second arrangement direction at regular intervals.

If all nozzles communicate with the same-side acute portions of the respective pressure chambers 10, the nozzles are uniformly arranged also in the second arrangement direction at regular intervals. In this case, nozzles are arranged so as to shift in the first arrangement direction by a distance corresponding to 600 dpi printing resolution per pressure chamber line from the lower side to the upper side of FIG. 8. Contrastingly in this embodiment, because four pressure chamber lines of two pressure chamber lines 11*a* and two pressure chamber lines 11*b* form a set of pressure chamber lines and such a set of pressure chamber lines is repeatedly disposed three times from the lower side, the shift of nozzle position in the first arrangement direction per pressure chamber line from the lower side to the upper side of FIG. 8 is not always the same.

In the ink-jet head 1 according to this embodiment, a band region R will be discussed that has a width (about 508.0 microns) corresponding to 50 dpi in the first arrangement direction and extends perpendicularly to the first arrangement direction. In this band region R, any of twelve pressure chamber lines includes only one nozzle. That is, when such a band region R is defined at an optional position in the ink ejection region corresponding to one actuator unit 21, twelve nozzles are always distributed in the band region R. The positions of points respectively obtained by projecting the twelve nozzles onto a straight line extending in the first arrangement direction are distant from each other by a distance corresponding to a 600 dpi printing resolution.

When the twelve nozzles included in one band region R are denoted by (1) to (12) starting from one whose projected image onto a straight line extending in the first arrangement direction is the leftmost, the twelve nozzles are arranged in the order of (1), (7), (2), (8), (5), (11), (6), (12), (9), (3), (10), and (4) from the lower side.

In the ink-jet head 1 structure according to this embodiment, by properly driving active layers in the actuator unit 21, a character, an figure, or the like, having a resolution of 600 dpi can be formed. That is, by selectively driving active layers corresponding to the twelve pressure chamber lines in order in accordance with the transfer of an image recording medium, a specific character or figure can be printed on the image recording medium.

By way of example, a case will be described wherein a straight line extending in the first arrangement direction is printed at a resolution of 600 dpi. First, a case will be briefly described wherein nozzles communicate with the same-side acute portions of pressure chambers 10. In this case, in accordance with transfer of an image recording medium, ink ejection starts from a nozzle in the lowermost pressure chamber line in FIG. 8. Ink ejection is then shifted upward with selecting a nozzle belonging to the upper neighboring pressure chamber line in order. Ink dots are thereby formed in order in the first arrangement direction with neighboring each other at 600 dpi. Finally, all the ink dots form a straight line extending in the first arrangement direction at a resolution of 600 dpi.

On the other hand, in this embodiment, ink ejection starts from a nozzle in the lowermost pressure chamber line 11*a* in FIG. 8, and ink ejection is then shifted upward with selecting a nozzle communicating with the upper neighboring pressure chamber line in order in accordance with transfer of an print medium. In this embodiment, however, because the positional shift of nozzles in the first arrangement direction per pressure chamber line from the lower side to the upper side is not always the same, ink dots formed in order in the first arrangement direction in accordance with the transfer of the print medium are not arranged at regular intervals at 600 dpi.

More specifically, as shown in FIG. 8, in accordance with the transfer of the print medium, ink is first ejected through a nozzle (1) communicating with the lowermost pressure chamber line 11*a* in FIG. 8 to form a dot row on the print medium at intervals corresponding to 50 dpi (about 508.0 microns). Next, as the print medium is transferred and the straight line formation position has reached the position of a nozzle (7) communicating with the second lowermost pressure chamber line 11*a*, ink is ejected through the nozzle (7). The second ink dot is thereby formed at a position shifted from the first formed dot position in the first arrangement direction by a distance of six times the interval corresponding to 600 dpi (about 42.3 microns) (about 42.3 microns*6=about 254.0 microns).

Next, as the print medium is further transferred and the straight line formation position has reached the position of a nozzle (2) communicating with the third lowermost pressure chamber line 11*b*, ink is ejected through the nozzle (2). The third ink dot is thereby formed at a position shifted from the first formed dot position in the first arrangement direction by a distance of the interval corresponding to 600 dpi (about 42.3 microns). As the print medium is further transferred and the straight line formation position has reached the position of a nozzle (8) communicating with the fourth lowermost pressure chamber line 11*b*, ink is ejected through the nozzle (8). The fourth ink dot is thereby formed at a position shifted from the first formed dot position in the first arrangement direction by a distance of seven times the interval corresponding to 600 dpi (about 42.3 microns) (about 42.3 microns*7=about 296.3 microns). As the print medium is further transferred and the straight line formation position has reached the position of a nozzle (5) communicating with the fifth lowermost pressure chamber line 11*a*, ink is ejected through the nozzle (5). The fifth ink dot is thereby formed at a position shifted from the first formed dot position in the first arrangement direction by a distance of four times the interval corresponding to 600 dpi (about 42.3 microns) (about 42.3 microns*4=about 169.3 microns).

After this, in the same manner, ink dots are formed with selecting nozzles communicating with pressure chambers 10 in order from the lower side to the upper side in FIG. 8. In this case, when the number of a nozzle in FIG. 8 is N, an ink dot is formed at a position shifted from the first formed dot position in the first arrangement direction by a distance corresponding to (magnification n=N−1)*(interval corresponding to 600 dpi). When the twelve nozzles have been finally selected, the gap between the ink dots to be formed by the nozzles (1) in the lowermost pressure chamber lines 11*a* in FIG. 8 at an interval corresponding to 50 dpi (about 508.0 microns) is filled up with eleven dots formed at intervals corresponding to 600 dpi (about 42.3 microns).

Therefore, a straight line extending in the first arrangement direction can be drawn at a resolution of 600 dpi.

Figure 9:
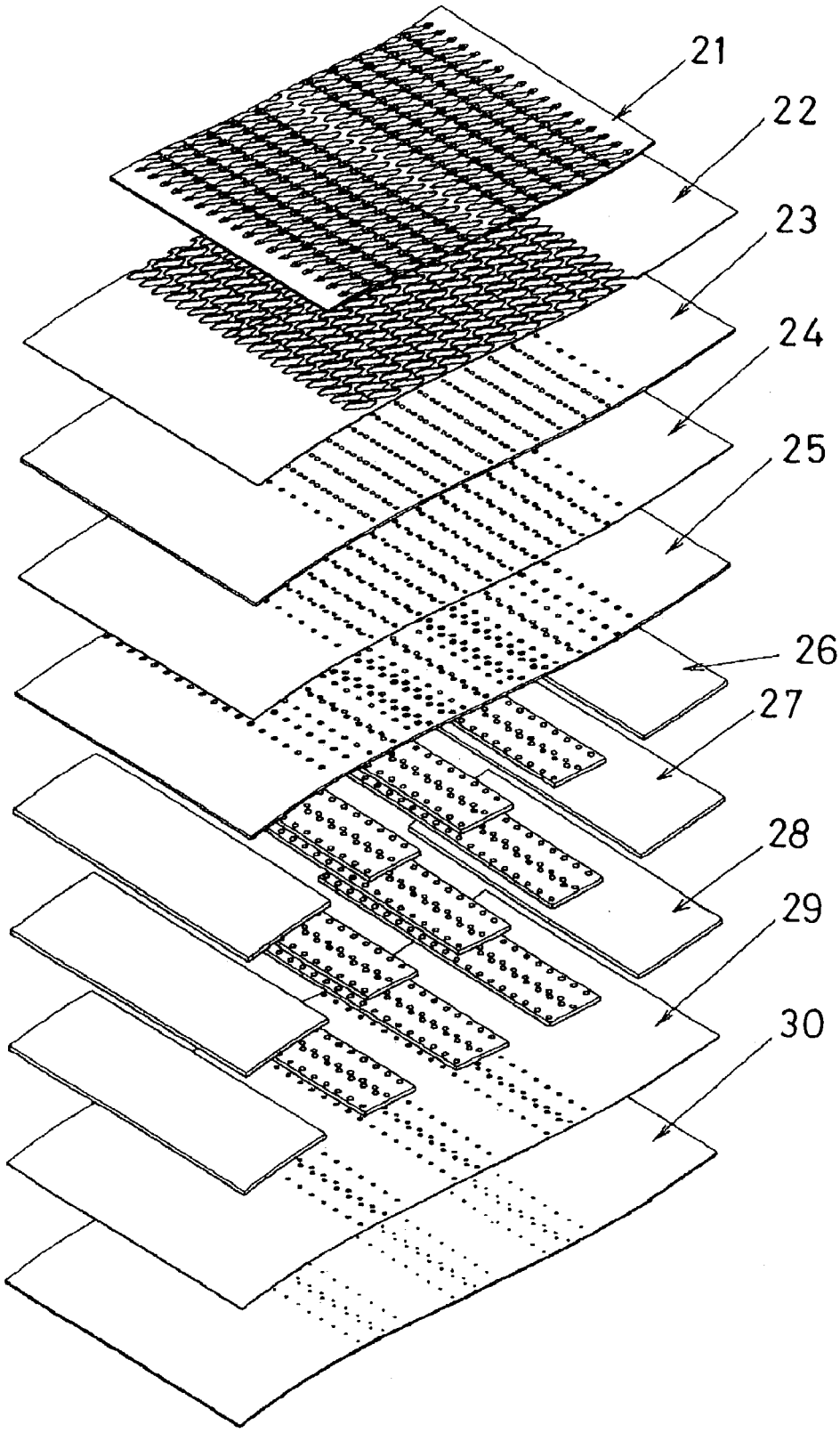
FIG. 9 is a partial expanded perspective view of the ink-jet head main body of FIG. 4.

Next, the sectional construction of the ink-jet head 1 according to this embodiment will be described. FIG. 9 is a partial exploded view of the head main body 1*a* of FIG. 4. Referring to FIGS. 7 and 9, a principal portion on the bottom side of the ink-jet head 1 has a layered structure laminated with ten sheet materials in total, i.e., from the top, an actuator unit 21, a cavity plate 22, a base plate 23, an aperture plate 24, a supply plate 25, manifold plates 26, 27, and 28, a cover plate 29, and a nozzle plate 30. Of them, nine plates other than the actuator unit 21 constitute a passage unit 4.

As described later in detail, the actuator unit 21 is laminated with four piezoelectric sheets 41 to 44 (see FIG. 11) and is provided with electrodes so that only the uppermost layer includes portions to be active only when an electric field is applied (hereinafter, simply referred to as "layer including active layers (active portions)"), and the remaining three layers are inactive. The cavity plate 22, which is made of metal, includes a large number of substantially rhombic openings that are formed corresponding to the respective pressure chambers 10. The base plate 23, which is also made of metal, includes a communication hole formed between each pressure chamber 10 of the cavity plate 22 and the corresponding aperture 12, and a communication hole formed between the pressure chamber 10 and the corresponding ink ejection port 8. The aperture plate 24, which is made of metal, includes, in addition to apertures 12, communication holes that are formed for connecting each pressure chamber 10 of the cavity plate 22 with the corresponding ink ejection port 8. The supply plate 25, which is made of metal, includes communication holes formed between each aperture 12 and the corresponding sub-manifold channel 5*a* and communication holes formed for connecting each pressure chamber 10 of the cavity plate 22 with the corresponding ink ejection port 8. Each of the manifold plates 26, 27, and 28, which is made of metal, defines an upper portion of each sub-manifold channel 5*a* and includes communication holes that are formed for connecting each pressure chamber 10 of the cavity plate 22 with the corresponding ink ejection port 8. The cover plate 29, which is made of metal, includes communication holes that arc formed for connecting each pressure chamber 10 of the cavity plate 22 with the corresponding ink ejection port 8. The nozzle plate 30, also made of metal, includes tapered ink ejection ports 8, each functioning as a nozzle, that are formed for the respective pressure chambers 10 of the cavity plate 22.

Sheets 21 to 30 are positioned in layers with each other to form such an ink passage 32 as shown in FIG. 6. The ink passage 32 first extends upward from the sub-manifold channel 5*a*, then extends horizontally in the aperture 12, then further extends upward, then again extends horizontally in the pressure chamber 10, then extends obliquely downward in a certain length away from the aperture 12, and then extends vertically downward toward the ink ejection port 8.

Figure 10:
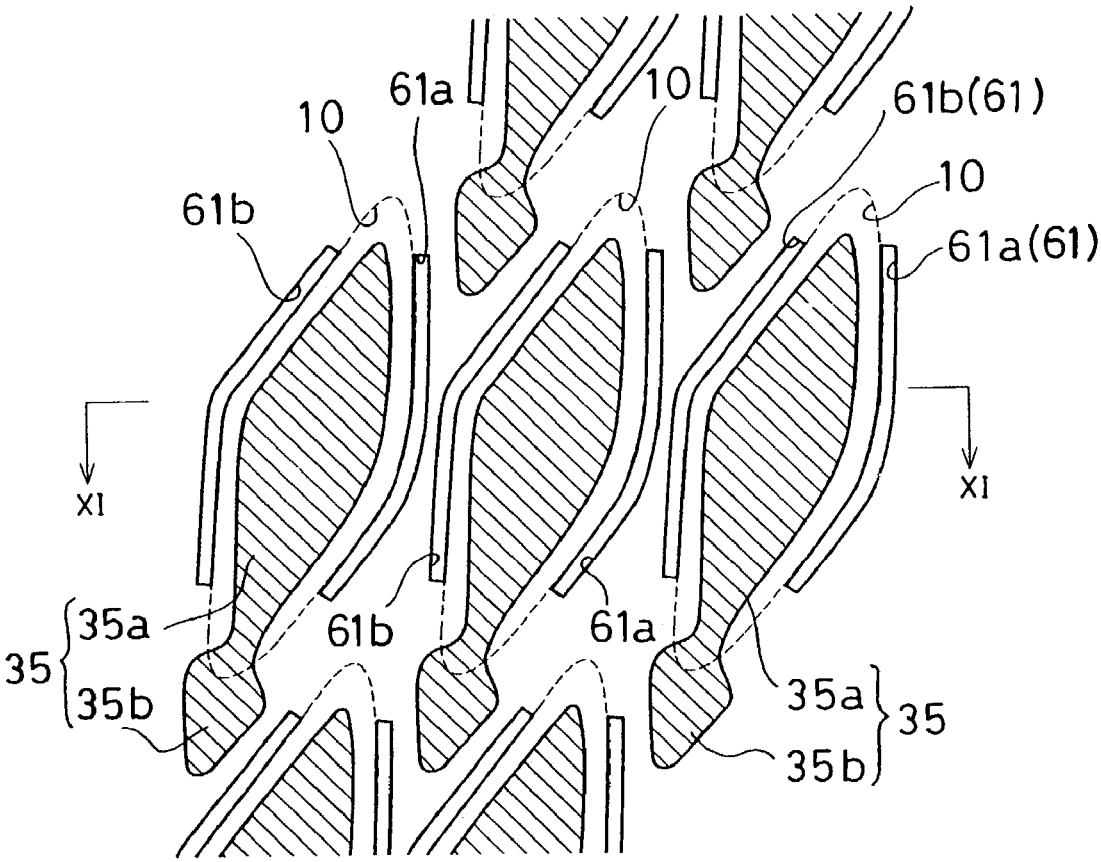
FIG. 10 is an enlarged plan view of an actuator unit.
Figure 11:
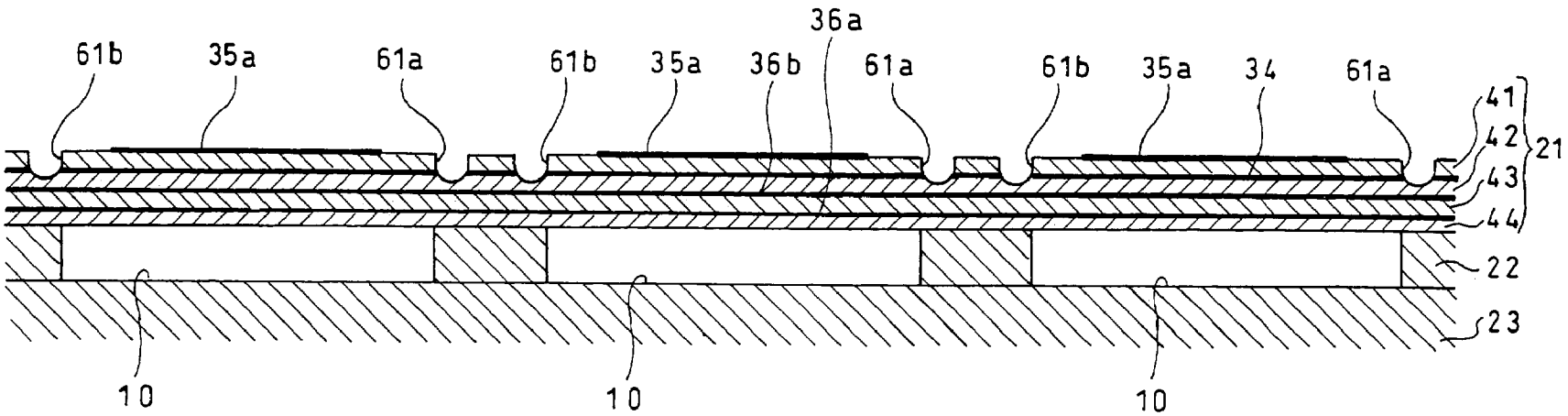
FIG. 11 is a partial sectional view of the ink-jet head main body of FIG. 4 along line XI—XI in FIG. 10.

Next, the detailed structure of each actuator unit 21 will be described. FIG. 10 is an enlarged view of an actuator unit 21. FIG. 11 is a partial sectional view of the head main body 1*a* of FIG. 4 along line X1—X1 in FIG. 10.

Referring to FIG. 10, an about 1.1 microns thick individual electrode 35 is provided on the upper surface of the actuator unit 21 at a position substantially overlapping each pressure chamber 10 in a plan view. The individual electrode 35 is made up of a substantially rhombic main electrode portion 35*a* and a substantially rhombic auxiliary electrode portion 35*b* formed continuously from one acute portion of the main electrode portion 35*a* to be smaller than the main electrode portion 35*a*. The auxiliary electrode portion 35*b* is connected with the acute portion of the main electrode portion 35*a* and the interconnecting part of them is made into a constricted shape. The main electrode portion 35*a* has a similar shape to that of the pressure chamber 10 and is smaller than the pressure chamber 10. The main electrode portion 35*a* is disposed so as to be included within the pressure chamber 10 in a plan view. Contrastingly, most part of the auxiliary electrode portion 35*b* is out of the pressure chamber 10 in the plan view. In the region of the upper face of the actuator unit 21 other than the individual electrodes 35, a piezoelectric sheet 41 as described later is exposed.

In the ink-jet head 1 of this embodiment, the portion other than the vicinity of the acute portions of the main electrode portion 35*a* of each individual electrode 35 is surrounded by grooves 61 each having a width of about 30 microns and a depth of about 20 to 25 microns. The grooves 61 include a groove 61*a* disposed on one side of the corresponding pressure chamber 10 in the first arrangement direction along the longitudinal direction of the ink-jet head 1, and a groove 61*b* disposed on the other side. Each of the grooves 61*a* and 61*b* is somewhat distant from the periphery of the main electrode portion 35*a* and has a V-shape. It is formed at substantially the same position as the inner wall of the pressure chamber 10 in a plan view. In this embodiment, in the second arrangement direction slightly oblique to the lateral direction of the ink-jet head 1, each groove 61*a* and 61*b* extends from a position somewhat distant from the acute end (acute portion) of the main electrode portion 35*a*, along the inner wall of the pressure chamber 10 in a plan view to the vicinity of the constricted portion interconnecting the main and auxiliary electrode portions 35*a* and 35*b*. Referring to FIG. 11, each groove 61*a* and 61*b* is formed through the piezoelectric sheet 41 including active layers, and its bottom is formed at a level of about half the thickness of the piezoelectric sheet 42.

Referring to FIG. 11, the actuator unit 21 includes four piezoelectric sheets 41, 42, 43, and 44 having the same thickness of about 15 microns. An FPC 136, used for supplying signals for controlling the potentials of each individual electrode 35 and the common electrode 34, is bonded to the actuator unit 21. The FPC 136 is fixed to, and electrically connected with, the auxiliary electrode portion 35*b* of each individual electrode 35 using solder or the like. The piezoelectric sheets 41 to 44 are made into a continuous layered flat plate (or continuous flat layers) that is so disposed as to extend over many pressure chambers 10 formed within one ink ejection region in the ink-jet head 1. Because the piezoelectric sheets 41 to 44 are disposed so as to extend over many pressure chambers 10 as the continuous flat layers, the individual electrodes 35 can be arranged at a high density, e.g., by using a screen printing technique. Therefore, the pressure chambers 10 formed at positions corresponding to the respective individual electrodes 35 can also be arranged at a high density. This makes it possible to print a high-resolution image. In this embodiment, each of the piezoelectric sheets 41 to 44 is made of a lead zirconate titanate (PZT)-base ceramic material having ferroelectricity.

Between the uppermost piezoelectric sheet 41 and the piezoelectric sheet 42 neighboring downward the piezoelectric sheet 41, an about 2 microns thick common electrode 34 is interposed formed on the entire lower face of the piezoelectric sheet 41. Further, as described above, on the upper face of the actuator unit 21, i.e., the upper face of the piezoelectric sheet 41, the individual electrodes 35 are formed to correspond to the respective pressure chambers 10. Each individual electrode 35 is made up of a main electrode portion 35*a* having a similar shape, for example, a length of 850 microns and a width of 250 microns, to each pressure chamber 10 in a plan view, the image of which electrode projected along its thickness is included within the corresponding pressure chamber 10, and a substantially rhombic auxiliary electrode portion 35*b* smaller than the main electrode portion 35*a*. Further, reinforcement metallic films 36*a* and 36*b* for reinforcing the actuator unit 21 are interposed between the piezoelectric sheets 43 and 44 and between the piezoelectric sheets 42 and 43, respectively. Each of the reinforcement metallic films 36*a* and 36*b*, formed substantially the entire area of the piezoelectric sheet 41 similar to the common electrode 34, has substantially the same thickness as the common electrode 34. In this embodiment, each individual electrode 35 is made of a layered metallic material in which nickel Ni (thickness: about 1 micron) and gold Au (thickness: about 0.1 micron) are formed as the lower and upper layers, respectively. Each of the common electrode 34 and the reinforcement metallic films 36*a* and 36*b* is made of a silver-palladium (Ag—Pd)-base metallic material. The reinforcement metallic films 36*a* and 36*b* do not function as electrodes so they are not always required. However, by providing the reinforcement metallic films 36*a* and 36*b*, the brittleness of the piezoelectric sheets 41 to 44 after sintering can be compensated. This enables piezoelectric sheets 41 to 44 to be easily handled.

The common electrode 34 is grounded in a region (not shown) through the FPC 136. Thus, the common electrode 34 is kept at the ground potential equally in the region corresponding to every pressure chamber 10. On the other hand, the individual electrodes 35 can be controlled in their potentials independently of one another for the respective pressure chambers 10. For this purpose, the substantially rhombic auxiliary electrode portion 35*b* of each individual electrode 35 is independently in contact with a lead (not shown) wired in the FPC 136. The individual electrode 35 is connected with a driver IC 132 through the lead. Thus, in this embodiment, because the individual electrodes 35 are connected with the FPC 136 at the auxiliary electrode portions 35*b* outside the pressure chambers 10 in a plan view, expansion and contraction of the actuator unit 21 in its thickness is less hindered. Therefore, the change in volume of each pressure chamber 10 can be increased. In a modification, many common electrodes 34 each having a shape larger than that of a pressure chamber 10 so that the projection image of each common electrode projected along the thickness of the common electrode may include the pressure chamber, may be provided for each pressure chamber 10. In another modification, many common electrodes 34, each having a shape somewhat smaller than that of a pressure chamber 10 so that the projection image of each common electrode projected along the thickness of the common electrode may be included in the pressure chamber, may be provided for each pressure chamber 10. Thus, the common electrode 34 may not always be a single conductive sheet formed on the whole of the face of a piezoelectric sheet. In the above modifications, however, all the common electrodes must be electrically connected with one another so that the portion corresponding to any pressure chamber 10 may be at the same potential.

In the ink-jet head 1 according to this embodiment, the piezoelectric sheets 41 to 44 are polarized in their thickness direction. That is, the actuator unit 21 has a so-called unimorph structure in which the uppermost (i.e., the most distant from the pressure chamber 10) piezoelectric sheet 41 includes active layers to be deformed when an external electric field is applied, and the lower (i.e., near the pressure chamber 10) three piezoelectric sheets 42 to 44 are inactive layers to be deformed due to the deformation of an active layer. Therefore, when an individual electrode 35 is set at a positive or negative predetermined potential, if the polarization is in the same direction as the electric field for example, the electric field-applied portion in the piezoelectric sheets 41 to 43 sandwiched by the electrodes works as an active layer to contract perpendicularly to the polarization by the transversal piezoelectric effect. On the other hand, because the piezoelectric sheets 42 to 44 are affected by lack of electric field, they do not contract in themselves. Thus, a difference in strain perpendicular to the polarization is produced between the uppermost piezoelectric sheet 41 and the lower piezoelectric sheets 42 to 44. As a result, the piezoelectric sheets 41 to 44 are ready to deform into a convex shape toward the inactive side (i.e., unimorph deformation). At this time, as shown in FIG. 11, because the lowermost face of the piezoelectric sheets 41 to 44 is fixed to the upper face of the partition (the cavity plate) 22 defining the pressure chamber, as a result, the piezoelectric sheets 41 to 44 deform into a convex shape toward the pressure chamber side. Therefore, the volume of the pressure chamber 10 is decreased to raise the pressure of ink. Therefore, the ink is ejected through the ink ejection port 8. After this, when the individual electrode 35 is returned to the same potential as that of the common electrode 34, the piezoelectric sheets 41 to 44 return to the original shape and the pressure chamber 10 also returns to its original volume. Thus, the pressure chamber 10 draws in ink through the manifold channel 5.

In another driving method, all the individual electrodes 35 are set in advance at a different potential from that of the common electrode 34. When an ejecting request is issued, the corresponding individual electrode 35 is set at the same potential as that of the common electrode 34. After this, at a predetermined timing, the individual electrode 35 is again set at a potential different from that of the common electrode 34. In this case, at the timing when the individual electrode 35 is set at the same potential as that of the common electrode 34, the piezoelectric sheets 41 to 44 return to their original shapes. The corresponding pressure chamber 10 is thereby increased in volume from its initial state (in which the potentials of both electrodes differ from each other), such that ink is drawn from the manifold channel 5 into the pressure chamber 10. After this, at the timing when the individual electrode 35 is again set at the different potential from that of the common electrode 34, the piezoelectric sheets 41 to 44 deform into a convex shape toward the pressure chamber 10. The volume of the pressure chamber 10 is thereby decreased and the pressure of ink in the pressure chamber 10 is raised to eject the ink.

On the other hand, in case where the polarization occurs in the reverse direction to the electric field applied to the piezoelectric sheets 41 to 44, the active layer in the piezoelectric sheet 41 sandwiched by the individual electrode 35 and the common electrode 34 is ready to elongate perpendicularly to the polarization by the transversal piezoelectric effect. As a result, the piezoelectric sheets 41 to 44 deform into a concave shape toward the pressure chamber 10. Therefore, the volume of the pressure chamber 10 is increased to draw ink from the manifold channel 5. After this, when the individual electrode 35 returns to its original potential, the piezoelectric sheets 41 to 44 also return to their original flat shape. The pressure chamber 10 thereby returns to its original volume to eject ink through the ink ejection port 8.

As described above, the ink-jet head 1 according to this embodiment is constructed so that the inactive layer side of each actuator unit 21 is fixed to the upper face of a partition 22 partitioning pressure chambers, and the only uppermost piezoelectric sheet 41 includes active layers each of which is spontaneously deformed by the piezoelectric effect. Because the uppermost piezoelectric sheet 41 not fixed includes the active layers, if no other measure is taken, the deformation of an active layer due to application of an external electric field may propagate to a neighboring region. In this embodiment, however, the grooves 61 a and 61*b* extending into the piezoelectric sheet 42 are formed by the portions other than the vicinity of the acute portion of the main electrode portion 35*a* of each individual electrode 35. In the second arrangement direction of pressure chambers 10, each of the two grooves 61*a* and 61*b* extends from a portion somewhat distant from the acute portion of the main electrode portion 35*a* along the corresponding pressure chamber 10 in a plan view up to the vicinity of the constricted portion interconnecting the main and auxiliary electrode portions 35*a* and 35*b*. Therefore, when looking around in the plane of the piezoelectric sheet 41 from the center of the main electrode portion 35*a* where a large deformation may occur when a voltage is applied to the individual electrode 35, at least one groove 61 exists in almost any direction in the plane. Thus, in comparison with a case wherein no groove 61 is provided, even when the active layer corresponding to a pressure chamber 10 is deformed, the amount of deformation of the piezoelectric sheet 41 of a portion corresponding to a neighboring pressure chamber 10 is little. That is, occurrence of so-called crosstalk is suppressed in which ink is ejected through an ink ejection port through which ink should not be ejected, or the amount of ejected ink is increased or decreased from the aimed value. As a result, because a good-quality image can be printed, the quality of the ink-jet printer is improved. Further, because pressure chambers 10 can be arranged at a higher density, a higher-resolution image can be formed.

When an active layer is driven, the deformation of the piezoelectric sheet 41 most distant from the fixture portion to the passage unit 4 is larger than those of the other piezoelectric sheets 42, 43, and 44. Therefore, by providing the grooves 61*a* and 61*b* in the upper face of the piezoelectric sheet 41, that is, in the opposite face of the actuator unit 21 to the face facing pressure chambers 10, the deformation propagated to a neighboring pressure chamber 10 side and crosstalk produced due to the propagation can effectively be reduced. In addition, the grooves 61*a* and 61*b* are formed in the upper face of the piezoelectric sheet 41, the manufacturing process is simple and they are easy to form, besides, the grooves 61*a* and 61*b* can be formed with a high positional accuracy.

In the ink-jet head 1 of this embodiment, each pair of grooves 61*a* and 61*b* formed through a common electrode 34 into the piezoelectric sheet 42 does not make an annular shape to completely surround the corresponding main electrode portion 35*a*. Therefore, the portion of the common electrode 34 corresponding to the main electrode portion 35*a* is not separated from the other portion and the common electrode 34 is made into one continuous body. Thus, wiring for the common electrode 34 may be easily manufactured.

Each actuator unit 21 has a unimorph structure in which three inactive piezoelectric sheets 42 to 44 are disposed between the piezoelectric sheet 41 including active layers and most distant from each pressure chamber 10 and the passage unit 4. Therefore, the change in volume of each pressure chamber 10 can be increased by the transversal piezoelectric effect in the corresponding active layer. As a result, in comparison with an ink-jet head in which a layer including active layers is provided on the pressure chamber 10 side and a inactive layer is provided on the opposite side, lowering the voltage to be applied to each individual electrode 35 and/or high integration of the pressure chambers 10 can be realized. By lowering the voltage to be applied, the driver for driving the individual electrodes 35 can be made small in size and the cost can be held down. Further, even in case of a high integration of the pressure chambers 10 by decreasing the size of each pressure chamber 10, a sufficient amount of ink can be ejected. Thus, a decrease in size of the head 1 and a highly dense arrangement of printing dots can be realized. Further, because only one layer includes active layers, the change in volume of each pressure chamber 10 can be made to be relatively large. Lowering the voltage to be applied to each individual electrode 35, a decrease in size of each pressure chamber 10, and high integration of the pressure chambers 10 can be intended thereby. This has been confirmed by the present inventor.

Further, in the ink-jet head 1 of this embodiment, because the piezoelectric sheet 41 most distant from each pressure chamber 10 includes active layers, another layer restricting the deformation of each active layer does not exist on the active layer. Therefore, in comparison with a case wherein the piezoelectric sheet most distant from each pressure chamber 10 is made into a inactive layer, the change in volume of each pressure chamber 10 by the transversal piezoelectric effect in the corresponding active layer can be made large. Further, a remarkable crosstalk suppression effect can be obtained by providing the grooves 61*a* and 61*b* neighboring the active layer.

In the ink-jet head 1, the only piezoelectric sheet 41 most distant from each pressure chamber 10 of each actuator unit 21 includes active layers, and individual electrodes 35 are provided on the opposite face (upper face) to the pressure chamber side face of the piezoelectric sheet 41. Therefore, when the actuator unit 21 is manufactured, there is no need of forming a through-hole for electrically connecting with each individual electrode formed within the actuator unit 21 to overlap in a plan view. Thus, the manufacture is easily performed.

In the ink-jet head 1, because the piezoelectric sheet 41 including active layers and the piezoelectric sheets 42 to 44 as the inactive layers are made of the same material, the material need not be changed in the manufacturing process. Thus, they can be manufactured through a relatively simple process, and a reduction of manufacturing cost is expected. Further, for the reason that each of the piezoelectric sheet 41 including active layers and the piezoelectric sheets 42 to 44 as the inactive layers has substantially the same thickness, a further reduction of cost can be intended by simplifying the manufacturing process. This is because the thickness control can easily be performed when the ceramic materials to be the piezoelectric sheets are applied to be put in layers.

As described above, the portion of the piezoelectric sheet 41 sandwiched by the common and individual electrodes 34 and 35 is deformed by the piezoelectric effect when a voltage is applied between the common and individual electrodes 34 and 35. For example, when the piezoelectric sheet 41 elongates in its thickness by applying the voltage, it constricts in the plane of the piezoelectric sheet 41. At this time, because other piezoelectric sheets 42, 43, and 44 exist as inactive layers between the piezoelectric sheet 41 and the corresponding pressure chamber 10, the whole of the active layer of the actuator unit 21 is deformed into a convex shape toward the pressure chamber 10. The amount of deformation of the actuator unit 21 at this time varies place to place dependently upon the relative position to the pressure chamber 10. More specifically, the amount of deformation of the actuator unit 21 whose deformation is restricted by a partition 22 is the maximum at the central portion of the pressure chamber 10 where the width of the partition 22 is large, and the minimum in the vicinity of the acute portion of the pressure chamber 10 where the width of the partition 22 is small.

In this case, in the vicinity of the central portion of the pressure chamber 10 where the amount of deformation in thickness is large, the deformation composed of the in-plane deformation and the thickness deformation of the active layer formed in the piezoelectric sheet propagates to the surroundings. If another pressure chamber 10 is disposed to neighbor the central portion of that pressure chamber 10, the propagated deformation adversely influences ink ejection as crosstalk to the other pressure chamber 10. In this embodiment, however, as described above, the portion other than the vicinity of the acute portion of the main electrode portion 35*a* of each individual electrode 35 is surrounded by the grooves 61 formed up to about half the thickness of the piezoelectric sheet 42. This feature effectively prevents the unnecessary deformation propagation in the vicinity of the central portion of each pressure chamber 10.

On the other hand, in the vicinity of the acute portion of each pressure chamber 10, even when an in-plane deformation is produced by applying a voltage between the common and individual electrodes 34 and 35, the deformation in thickness is very small or little. Further, because the actuator unit 21 is fixed to the partition 22 of the passage unit 4, the in-plane deformation of the active layer is hard to propagate. Therefore, although the in-plane deformation propagates a little to another pressure chamber 10 neighboring the acute portion of that pressure chamber 10, the propagated deformation less influences ink ejection as crosstalk. Hence, as shown in FIG. 10, no grooves 61 are provided near the acute portion of each pressure chamber 10. By providing no grooves 61 near the acute portion of each pressure chamber 10, the continuity of the common electrode 34 formed on the piezoelectric sheet 41 is ensured.

Next, a manufacturing method of the ink-jet head 1 according to this embodiment will be described with reference to FIG. 12.

To manufacture the ink-jet head 1, a passage unit 4 and each actuator unit 21 are separately manufactured in parallel and then both are bonded to each other. To manufacture the passage unit 4, each plate 22 to 30 forming the passage unit 4 is subjected to etching using a patterned photoresist as a mask, thereby forming openings and recesses as shown in FIGS. 7 and 9 in the respective plates 22 to 30. After this, the nine plates 22 to 30 are put in layers with adhesives being interposed so as to form therein ink passages 32. The nine plates 22 to 30 are thereby bonded to each other to form a passage unit 4.

To manufacture each actuator unit 21, first, a conductive paste to be a reinforcement metallic film 36*a* is printed in a pattern on a ceramic green sheet to be a piezoelectric sheet 44. In parallel with this, a conductive paste to be a reinforcement metallic film 36*b* is printed in a pattern on a ceramic green sheet to be a piezoelectric sheet 43 and a conductive paste to be a common electrode 34 is printed in a pattern on a ceramic green sheet to be a piezoelectric sheet 42. After this, four green sheets to be piezoelectric sheets 41 to 44 are put in layers with being positioned with a jig. The thus obtained layered structure is then baked at a predetermined temperature. After this, individual electrodes 35 are formed on the piezoelectric sheet 41 of the baked layered structure. For example, the individual electrodes 35 may be formed in the manner that a conductive film is plated on the whole of one surface of the piezoelectric sheet 41 and then unnecessary portions of the conductive film are removed by laser patterning. Alternatively, the individual electrodes 35 may be formed by depositing a conductive film on the piezoelectric sheet 41 by PVD (Physical Vapor Deposition) using a mask having openings at portions corresponding to the respective individual electrodes 35. To this process, the manufacture of the actuator unit 21 is completed.

Moreover, considering the evaporation upon baking as mentioned above, it may be possible to print a pattern of the individual electrodes 35 made of metal paste and then bake the individual electrodes 35, after the piezoelectric sheets 41 to 44 are baked. In this case, because the piezoelectric sheets 41 to 44 have already been adequately contracted while being baked, the dimension of the piezoelectric sheets 41 to 44 are hardly varied by contraction when the individual electrodes are baked. Therefore, the individual electrodes 35 and the corresponding pressure chambers 10 can be aligned with good accuracy just as in the case that the individual electrodes 35 are formed by plating method or vapor deposition method.

As mentioned above, providing of the reinforcement metallic films 36*a* and 36*b* can reinforce brittleness of the piezoelectric sheets 41 to 44, thereby improving the handling ability of the piezoelectric sheets 41 to 44. However, it is not always necessary to provide the reinforcement metallic films 36*a* and 36*b*. For example, when the size of the actuator unit 21 is approximately 1 inch, the handling ability of the piezoelectric sheets 41 to 44 is not damaged by brittleness even if the reinforcement metallic films 36*a* and 36*b* are not provided.

Further, according to this embodiment, the individual electrodes 35 are formed only on the piezoelectric sheet 41 as described above. On the other hand, when the individual electrodes are also formed on the other piezoelectric sheets 42 to 44 than the piezoelectric sheet 41, the individual electrodes have to be printed on the desired piezoelectric sheets 41 to 44 before laminating and baking the piezoelectric sheets 41 to 44. Accordingly, the contraction of piezoelectric sheets 41 to 44 in baking causes a difference between the positional accuracy of the individual electrodes on the piezoelectric sheets 42 to 44 and the positional accuracy of the individual electrodes 35 on the piezoelectric sheet 41. According to this embodiment, however, because the individual electrodes 35 are formed only on the piezoelectric sheet 41, such difference in positional accuracy is not caused and the individual electrodes 35 and the corresponding pressure chambers 10 are aligned with good accuracy.

Next, the actuator unit 21 manufactured as described above is bonded to the passage unit 4 with an adhesive so that the piezoelectric sheet 44 is in contact with the cavity plate 22. At this time, both are bonded to each other on the basis of marks for positioning formed on the surface of the cavity plate 22 of the passage unit 4 and the surface of the piezoelectric sheet 41, respectively.

Figure 12:
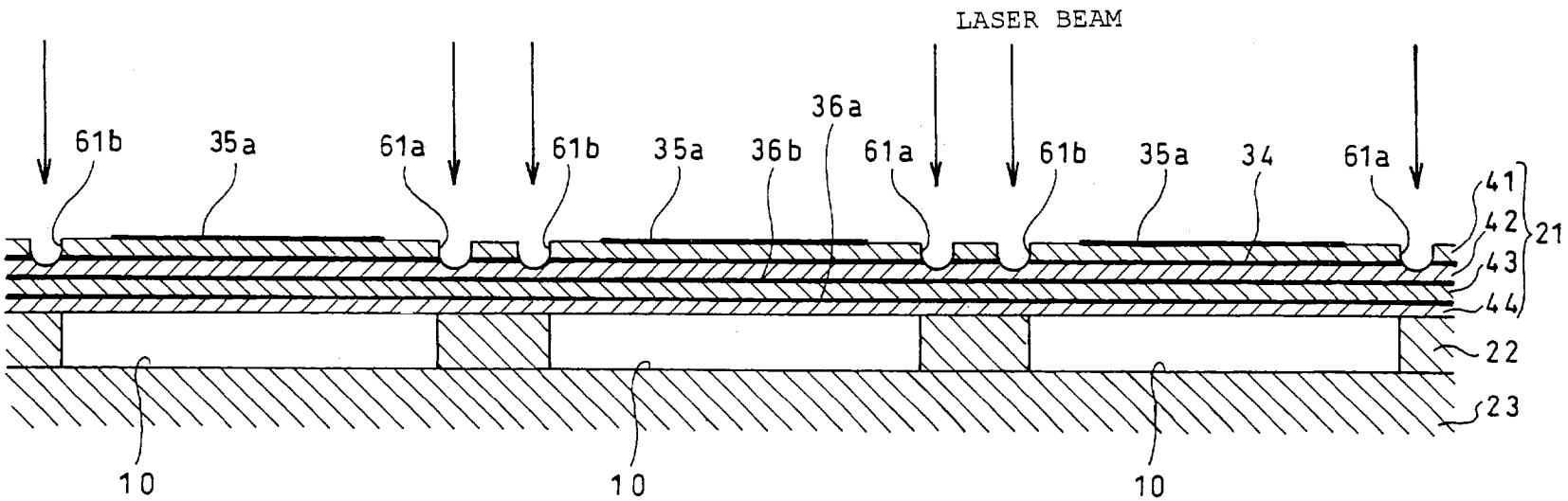
FIG. 12 is a partial sectional view of the ink-jet head main body of FIG. 4 during manufacture, as corresponding to FIG. 11.

Next, as shown in FIG. 12, on the basis of the main electrode portions 35*a* of the respective individual electrodes 35, laser processing is performed with, e.g., YAG laser, with controlling the emission direction so that the portion somewhat outside of the edge of each pressure chamber 10 in a plan view is irradiated with laser beams. By this laser processing, grooves 61*a* and 61*b* each having a V-shape and extending up to about half the piezoelectric sheet 42 are formed on both sides of each main electrode portion 35*a*.

After this, an FPC 136 used for supplying electric signals to the individual electrodes 35 is bonded onto and electrically connected with the actuator unit 21 using solder or the like. Further, through a predetermined process, the manufacture of the ink-jet head 1 is completed.

In the above-described manufacturing method, no individual electrodes are formed between neighboring piezoelectric sheets upon putting the piezoelectric sheets in layers. That is, the only piezoelectric sheet 41 most distant from each pressure chamber 10 includes active layers. Therefore, there is no need of forming through-holes in the piezoelectric sheets 41 to 44 for interconnecting the individual electrodes formed to overlap in a plan view. Thus, as described above, the ink-jet head 1 according to this embodiment can be manufactured through a relatively simple process at a low cost.

In the above-described manufacturing method, differently from the common electrode 34 and the reinforcement metallic films 36*a* and 36*b*, the only individual electrodes 35 are not baked together with the ceramic materials to be the piezoelectric sheets 41 to 44. The reason is as follows. That is, because the individual electrodes 35 are exposed, they are apt to evaporate at a high temperature upon baking. Thus, the thickness control of them is harder than those of the common electrode 34 and so on covered with a ceramic material. However, because even the common electrode 34 and so on are somewhat decreased in thickness, if keeping the continuity after baking is taken into consideration, it is hard to decrease the thickness. On the other hand, because the individual electrodes 35 are formed by the above-described technique after baking, they can be formed to be thinner than the common electrode 34 and so on. Thus, in the ink-jet head 1 of this embodiment, by forming the individual electrodes 35 at the uppermost level to be thinner than the common electrode 34, the deformation of the piezoelectric sheet 41 including active layer is difficult to be restricted by the individual electrodes 35. This may improve the change in volume of each pressure chamber 10 in the ink-jet head 1.

In this embodiment, each of the grooves 61*a* and 61*b* is formed into the second uppermost piezoelectric sheet 42. However, the grooves may be formed only within the uppermost piezoelectric sheet 41, i.e., so as not to reach the second uppermost piezoelectric sheet 42. Otherwise, the grooves may be formed up to the third or fourth uppermost piezoelectric sheet 43 or 44. If the grooves are to be formed up to the second, third, or fourth uppermost piezoelectric sheet, each groove is preferably not annular so that the common electrode 34 may not be separated into parts and at least part of any portion of common electrode 34 may be connected with the other portion. However, the common electrode 34 may be separated into parts if wiring is provided for the separated parts.

In this embodiment, the slender grooves 61*a* and 61*b* are formed as recesses. However, the recesses may not always be such slender grooves. For example, a recess or recesses each having a circular shape in a plan view may be formed in a region between each neighboring pressure chambers 10. However, such slender grooves as described above are preferable because they make the crosstalk suppression effect higher.

In this embodiment, the slender grooves 61*a* and 61*b* are formed as recesses to correspond to the respective edges of each pressure chamber 10 in a plan view. However, two or more such slender grooves may be provided in parallel with each other along each edge of the pressure chamber. The width of each groove can optionally be changed as long as it does not hinder the operation of the piezoelectric sheets.

In this embodiment, the grooves 61*a* and 61*b* are formed by laser processing. However, the grooves can be formed by various methods other than laser processing, e.g., by etching using a patterned photoresist as a mask.

Further, the recesses may be formed before the actuator unit 21 is bonded to the passage unit 4, or after the bonding process as described above. Further, in case that the individual electrodes 35 are formed on the uppermost piezoelectric sheet 41 by laser processing, a conductive film is formed on the whole of the upper face of the piezoelectric sheet 41 and then portions of the conductive film not to be the individual electrodes 35 are removed by laser processing. In this case, the recesses may be formed in the piezoelectric sheet 41 at the same time when the portions of the conductive film are removed.

Further, in the above-described embodiment, the only uppermost piezoelectric sheet 41 most distant from each pressure chamber 10 includes active layers. However, the uppermost piezoelectric sheet 41 may not always include active layers. Further, another piezoelectric sheet as well as the uppermost piezoelectric sheet 41 may include active layers. Even in these cases, a sufficient crosstalk suppression effect can be obtained. Further, the ink-jet head of the above-described embodiment has a unimorph structure using the transversal piezoelectric effect. However, the present invention is applicable also to an ink-jet head using the longitudinal piezoelectric effect in which an active layer is disposed on the pressure chamber side of a inactive layer. Further, in the above-described embodiment, all the inactive layers are made of piezoelectric sheets. However, the inactive layers may be made of insulating sheets other than piezoelectric sheets.

Next, ink-jet heads according to the second to sixth embodiments of the present invention will be described. The ink-jet heads according to these embodiments differ from that of the first embodiment only in the feature of position and shape of each groove formed in an actuator unit. Therefore, in the drawings concerning these embodiments, the same components as in the first embodiment are denoted by the same reference numerals as in the first embodiment, and the description thereof is omitted.

Figure 13:
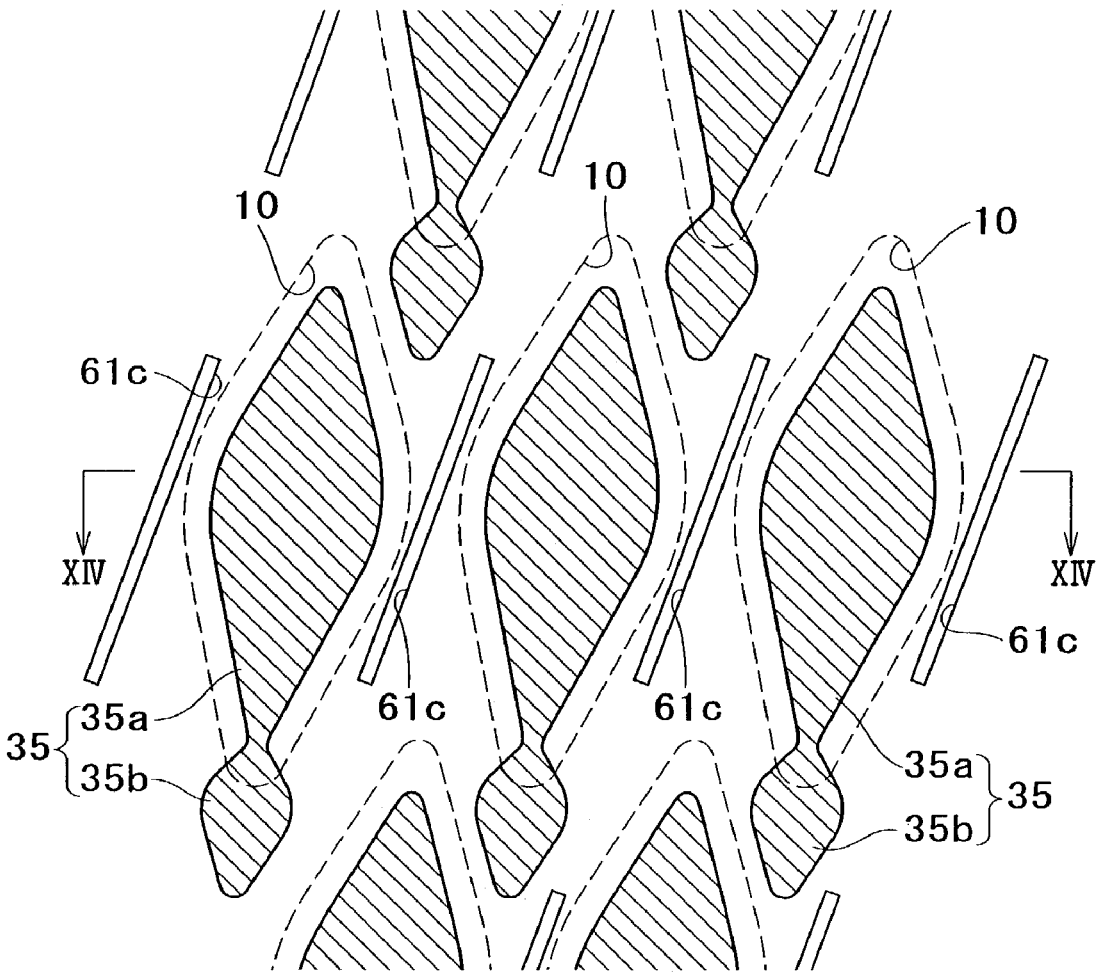
FIG. 13 is an enlarged plan view of the actuator unit included in the ink-jet head according to the second embodiment of the invention.
Figure 14:
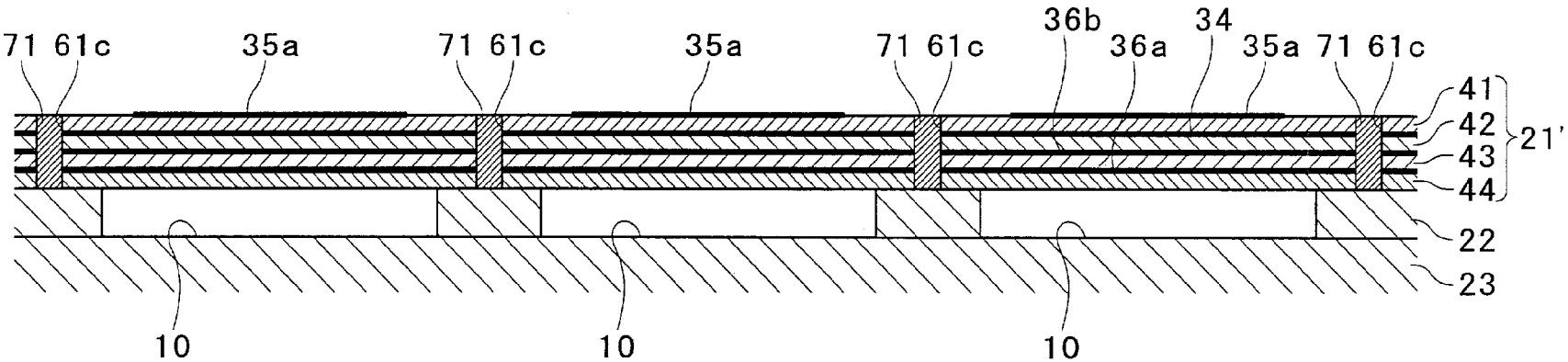
FIG. 14 is a partial sectional view of an ink-jet head main body included in the ink-jet head according to the second embodiment of the invention.

FIG. 13 is an enlarged plan view of an actuator unit in an ink-jet head according to the second embodiment of the present invention. FIG. 14 is a sectional view taken along line XIII—XIII in FIG. 13.

Referring to FIG. 13, in the ink-jet head of this embodiment, between two individual electrodes 35 neighboring each other in the first arrangement direction on the upper face of an actuator unit 21', a substantially straight groove 61*c* is provided in parallel with the longer diagonal of each main electrode portion 35*a* to correspond to the portion other than the vicinity of the acute portion of each main electrode portion 35*a*. Referring to FIG. 14, each groove 61*c* is formed through the actuator unit 21' and has its bottom on the upper face of the cavity plate 22.

The thus constructed actuator unit 21' is manufactured as follows. That is, as described above, a conductive paste to be a reinforcement metallic film 36*b* or a common electrode 34 is printed in a pattern on each piezoelectric sheet to constitute the actuator unit 21'. The piezoelectric sheets are put in layers and then baked at a predetermined temperature. Further, in the baked layered structure, individual electrodes 35 are formed on the piezoelectric sheet 41. After the actuator unit 21' is fixed to a passage unit 4 with an adhesive, straight through-holes to be grooves 61*c* are formed by laser processing with YAG laser with controlling the output of the YAG laser, the times of irradiation with the YAG laser, and the irradiation direction with the YAG laser. After this, as shown in FIG. 14, an FPC 136 for supplying electric signals to the individual electrodes 35 is bonded to the actuator unit 21' and thereby the manufacture of the ink-jet head 1 is completed.

In the above-described form of groove 61*c*, because each groove 61*c* is formed into a through-hole extending from the upper face of the actuator unit 21' to the opposite face of the actuator unit 21', there is no ceramic material that propagates the deformation of an active layer produced due to application of a voltage between an individual electrode 35 and the common electrode 32, to a neighboring pressure chamber side. Therefore, propagation of the deformation to the neighboring pressure chamber side, i.e., crosstalk, can be suppressed more effectively. Further, each groove 61*c* as a through-hole is formed to correspond to the portion between neighboring pressure chambers of the passage unit 4 and to leave a thickness as large as possible so that the actuator unit 21' is surely bonded and fixed. Thus, the mechanical rigidity as a piezoelectric element can be held high and the responsibility of ink ejection performance in the ink-jet head 1 can be improved.

Each groove 61*c* may be filled up with silicone rubber 71 to prevent corrosion of the electrode exposed in the groove 61*c*. Silicone rubber 71 is a material hard to propagate deformation in comparison with the piezoelectric sheets 41 to 44.

Because each groove 61*c* is thus formed through the actuator unit 21', when the active layer corresponding to a pressure chamber 10 is driven, deformation propagating to another pressure chamber 10 neighboring that pressure chamber 10 and crosstalk thus produced can be reduced very effectively.

Such grooves formed through an actuator unit can be applied not only to this embodiment but also to the above-described first embodiment and the third to fifth embodiments as described later. In this embodiment, each groove 61*c* may not be formed through the actuator unit 21'. In this case, because only one groove is formed between each neighboring individual electrodes 35, the manufacture process is simplified in comparison with the first embodiment.

Figure 15:
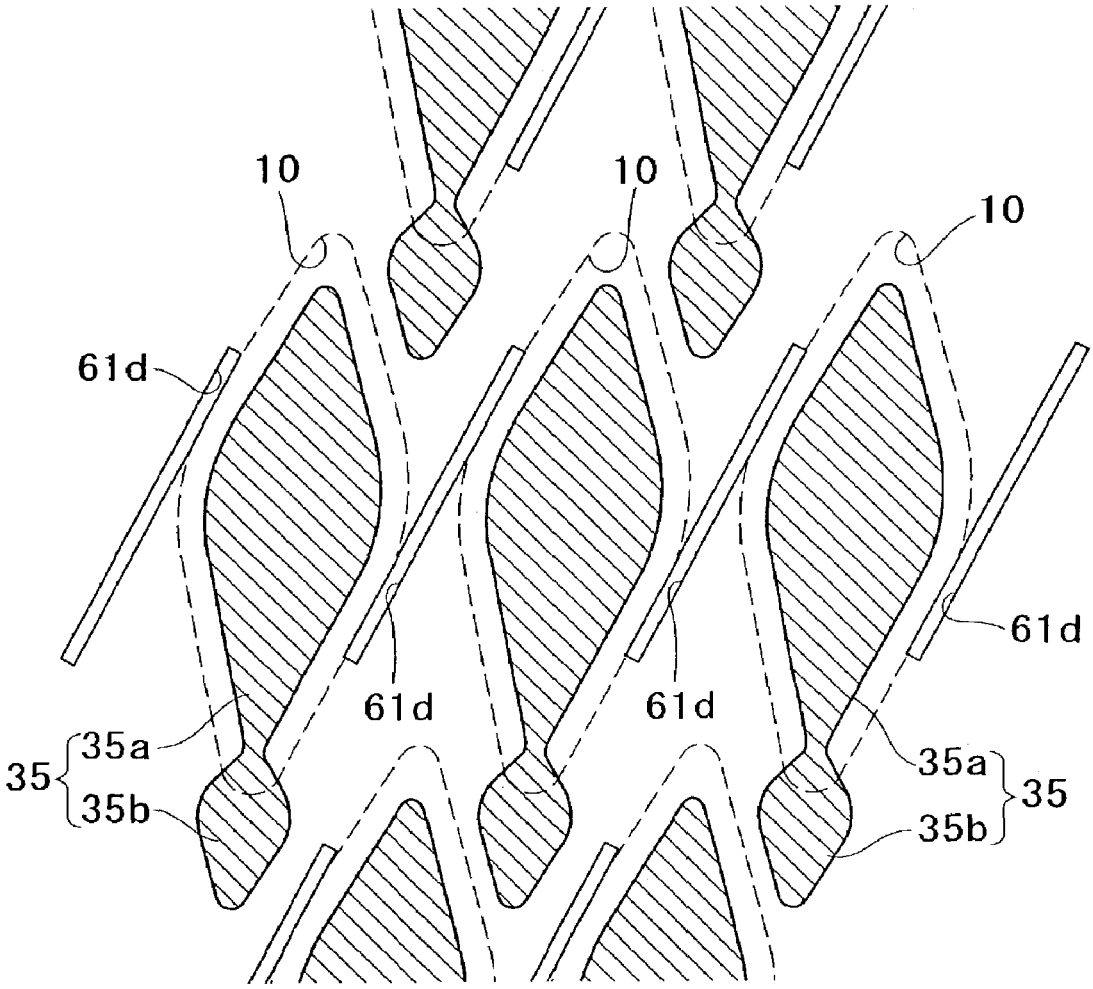
FIG. 15 is an enlarged plan view of an actuator unit included in an ink-jet head according to the third embodiment of the invention.

Next, an ink-jet head according to the third embodiment of the present invention will be described. FIG. 15 is an enlarged plan view of an actuator unit in an ink-jet head according to this embodiment.

Referring to FIG. 15, in the ink-jet head of this embodiment, a substantially straight groove 61*d* is provided in the upper face of an actuator unit to extend from a position somewhat distant from the lower right side of the main electrode portion 35*a* of each individual electrode 35 and substantially the same as the inner wall of the corresponding pressure chamber 10 in a plan view (except the vicinity of the acute portion of the main electrode portion 35*a*), to a portion somewhat distant from the upper left side of the main electrode portion 35*a* of the individual electrode 35 neighboring the right side of the above individual electrode 35 in the first arrangement direction and at substantially the same position as the inner wall of the corresponding pressure chamber 10 in a plan view (except the vicinity of the acute portion of the main electrode portion 35*a*). Each groove 61*d* is formed through the piezoelectric sheet 41 and has its bottom at about half the thickness of the piezoelectric sheet 42. Also in this embodiment, like the first embodiment, by provision of the grooves 61*d*, when the active layer corresponding to a pressure chamber 10 is driven, deformation propagating to a neighboring pressure chamber 10 and crosstalk thus produced can be reduced.

Figure 16:
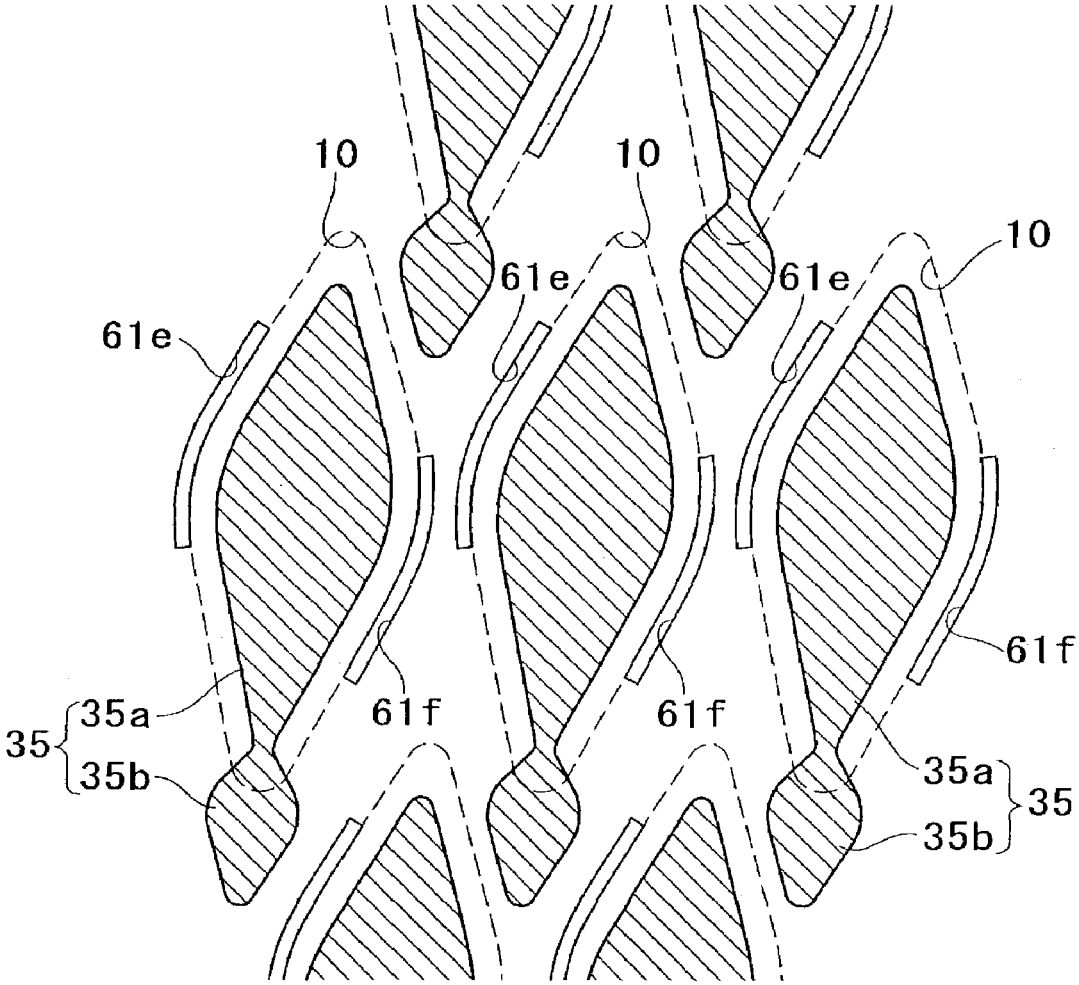
FIG. 16 is an enlarged plan view of an actuator unit included in an ink-jet head according to the fourth embodiment of the invention.

Next, an ink-jet head according to the fourth embodiment of the present invention will be described. FIG. 16 is an enlarged plan view of an actuator unit in an ink-jet head according to this embodiment.

Referring to FIG. 16, in the ink-jet head of this embodiment, in the upper face of an actuator unit, a substantially straight groove 61*e* is provided in a portion somewhat distant from the upper left side of the main electrode portion 35*a* of each individual electrode 35 and at substantially the same position as the inner wall of the corresponding pressure chamber 10 in a plan view (except the vicinity of the acute portion of the main electrode portion 35*a*), and another substantially straight groove 61*f* is provided in a portion somewhat distant from the lower right side of the main electrode portion 35*a* of each individual electrode 35 and at substantially the same position as the inner wall of the corresponding pressure chamber 10 in a plan view (except the vicinity of the acute portion of the main electrode portion 35*a*). Each of the grooves 61*e* and 61*f* is formed through the piezoelectric sheet 41 and has its bottom at about half the thickness of the piezoelectric sheet 42.

The lower end of each groove 61*e* is in the somewhat lower portion of the interconnecting part between the upper and lower left sides of the corresponding main electrode portion 35*a*. On the other hand, the upper end of each groove 61*f* is in the somewhat upper portion of the interconnecting part between the upper and lower right sides of the corresponding main electrode portion 35*a*. That is, the grooves 61*e* and 61*f* in each pair partially overlap each other along the longer diagonal of the main electrode portion 35*a*. Thus, although each of the grooves 61*e* and 61*f* is relatively short, because they are provided so as to partially overlap each other along the longer diagonal of the main electrode portion 35*a*, when the active layer corresponding to a pressure chamber 10 is driven, deformation propagating to a neighboring pressure chamber 10 and crosstalk thus produced can be reduced, like the first embodiment. Moreover, the same effect can be obtained even in case that the lower end portion of the groove 61*e* and the upper end portion of the groove 61*f* do not overlap each other along the longer diagonal of the main electrode portion 35*a* and both portions are at substantially the same position along the longer diagonal of the main electrode portion 35*a*.

Figure 17:
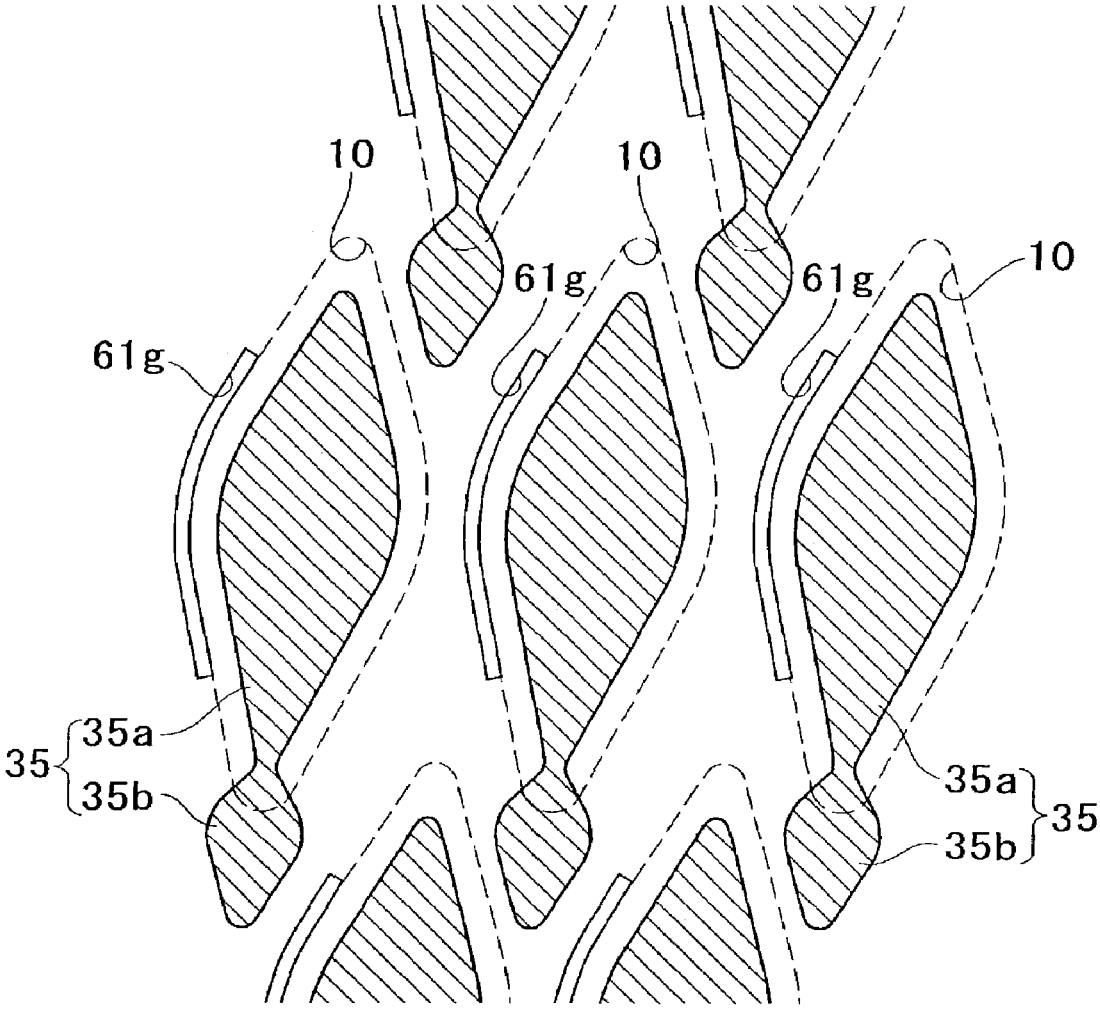
FIG. 17 is an enlarged plan view of an actuator unit included in an ink-jet head according to the fifth embodiment of the invention.

Next, an ink-jet head according to the fifth embodiment of the present invention will be described. FIG. 17 is an enlarged plan view of an actuator unit in an ink-jet head according to this embodiment.

Referring to FIG. 17, in the ink-jet head of this embodiment, in the upper face of an actuator unit, a V-shaped groove 61*g* is provided in a portion somewhat distant from the left side of the main electrode portion 35*a* of each individual electrode 35 and at substantially the same position as the inner wall of the corresponding pressure chamber 10 in a plan view (except the vicinity of the acute portion of the main electrode portion 35*a*). Each groove 61*g* is formed through the piezoelectric sheet 41 and has its bottom at about half the thickness of the piezoelectric sheet 42. Also in this embodiment, like the first embodiment, by provision of the grooves 61*f*, when the active layer corresponding to a pressure chamber 10 is driven, deformation propagating to a neighboring pressure chamber 10 and crosstalk thus produced can be reduced.

Figure 18:
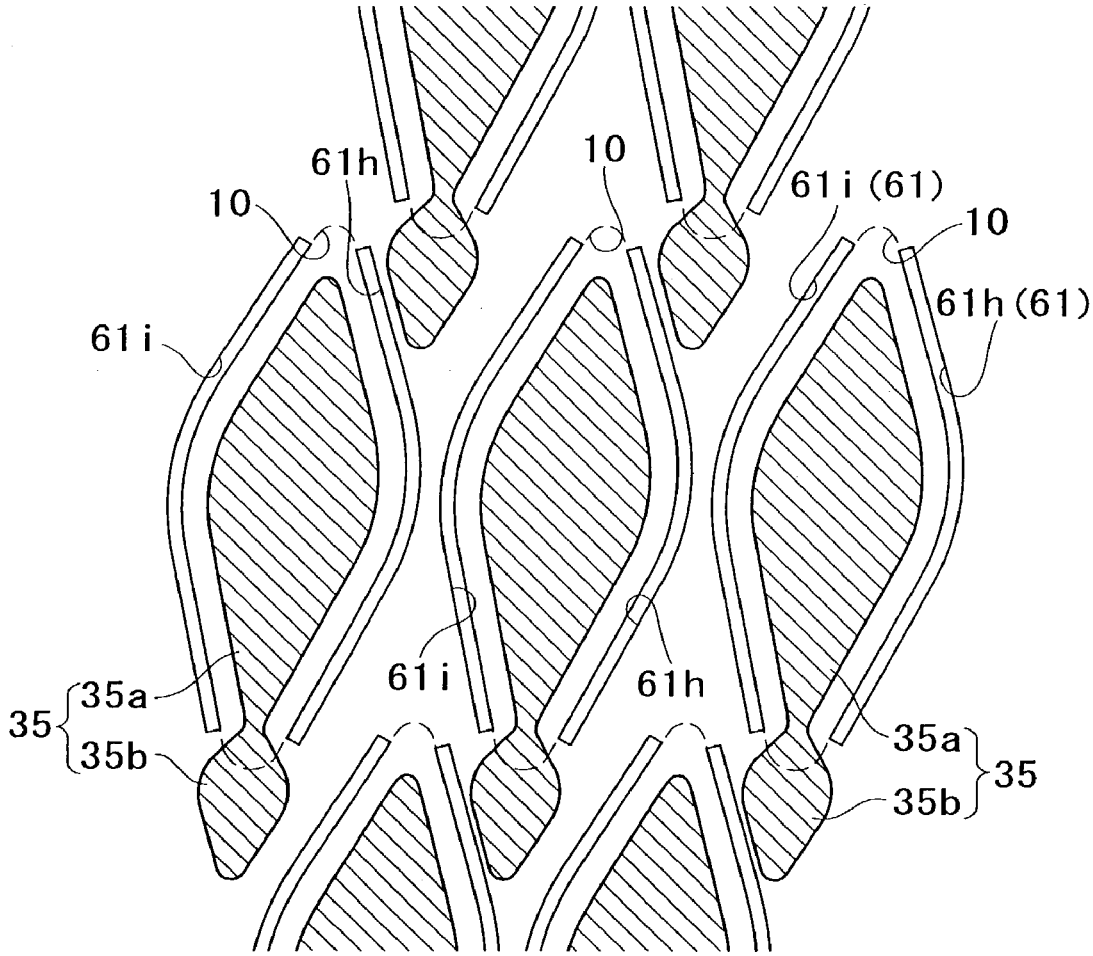
FIG. 18 is an enlarged plan view of an actuator unit included in an ink-jet head according to the sixth embodiment of the invention.

Next, an ink-jet head according to the sixth embodiment of the present invention will be described. FIG. 18 is an enlarged plan view of an actuator unit in an ink-jet head according to this embodiment.

Referring to FIG. 18, the ink-jet head of this embodiment has grooves 61*h* and 61*i* longer than the grooves 61*a* and 61*b* of the first embodiment and each extending to a position nearer to the acute portion of the corresponding pressure chamber 10. In this case, when looking around from the center of the central pressure chamber 10 in FIG. 18 to the directions of six pressure chambers 10 in FIG. 18 neighboring the central pressure chamber 10, at least one groove 61 exists in any direction. Therefore, a very high crosstalk suppression effect can be obtained.

Further, as apparent from the above description, in this embodiment, when looking around to the second arrangement direction from the center of the main electrode portion 35*a* causing the large displacement, at least one groove 61 exists between the center of one pressure chamber 10 and another pressure chamber 10 neighboring in the second arrangement direction. Therefore, when the active layer corresponding to one pressure chamber 10 is deforms, the volume of deformation of the piezoelectric sheet 41 in the portion corresponding to another pressure chamber 10 neighboring in the second arrangement direction is reduced, compared with the case of not forming the groove 61. The pressure chambers 10 neighboring in the second arrangement direction are often simultaneously driven in printing. Thus, the occurrence of crosstalk negatively influencing image quality can be considerably controlled by forming at least one groove 61 in correspondence with the portion between the pressure chambers 10 neighboring in the second arrangement direction as this embodiment.

As apparent from the above-described first to sixth embodiments, in the present invention, the position and shape of each groove provided in an actuator unit can be various. For example, the grooves 61*a* and 61*b* described in the first embodiment and the grooves 61*c* described in the second embodiment may be provided together in an actuator unit.

In the above-described embodiments, the materials of each piezoelectric sheet and each electrode are not limited to the above-described ones. They can be changed to other known materials. The shapes in plan and sectional views of each pressure chamber, the arrangement of pressure chambers, the number of layers including active layers, the number of inactive layers, etc., can be changed properly. For example, only one actuator unit may be bonded to the passage unit. The piezoelectric sheet including active layers may differ in thickness from each inactive layer.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit including a plurality of pressure chambers each having one end coupled to a nozzle and the other end being able to be coupled to an ink supply source, the plurality of pressure chambers being arranged in a matrix to neighbor each other; and an actuator unit attached to a surface of the passage unit for changing the volume of each of the pressure chambers, the actuator unit comprising:

a plurality of deformable sheets including plurality of piezoelectric sheets disposed to continuously extend over the chambers, wherein an uppermost piezoelectric sheet is an active layer that is deformed when an external electric field is applied;

a common electrode disposed on one side of the uppermost piezoelectric sheet, the common electrode kept at a constant potential;

a plurality of individual electrodes disposed on the other side of the uppermost piezoelectric sheet at positions respectively corresponding to the pressure chambers; and recesses formed in regions of the uppermost piezoelectric sheet corresponding to portions between the pressure chambers, wherein the recesses suppress a deformation that propagates in a plane direction of the uppermost piezoelectric sheet.

2. The ink-jet head according to claim 1, wherein each of the pressure chambers is substantially rhombic and the pressure chambers are arranged in a matrix so that sides of the pressure chambers are parallel with each other, and each of the individual electrodes has a shape similar to a shape of each of the pressure chambers.

3. The ink-jet head according to claim 2, wherein each of the recesses is formed along an edge of the corresponding one of the pressure chambers.

4. The ink-jet head according to claim 3, wherein each of the recesses is formed so as to correspond to a region other than an acute portion of the corresponding one of the individual electrodes.

5. The ink-jet head according to claim 3, wherein the passage unit comprises a plurality of lines in each of which a plurality of pressure chambers are arranged, a recess is formed between one pressure chamber in one line and another pressure chamber in the line neighboring the one pressure chamber, and at least one recess is formed in a region between the one pressure chamber and the other pressure chamber when viewing from a center of the one pressure chamber toward the other pressure chamber.

6. The ink-jet head according to claim 3, wherein the recesses are formed in regions between one pressure chamber and at least six pressure chambers neighboring the one pressure chamber, and at least one recess is formed in a region between the one pressure chamber and the pressure chambers neighboring the one pressure chamber when viewing from the one pressure chamber toward the pressure chambers neighboring the one pressure chamber.

7. The ink-jet head according to claim 3, wherein the recesses are formed in an opposite face to a face fixed to the surface of the passage unit.

8. The ink-jet head according to claim 2, wherein each of the recesses is formed so as to substantially enclose the corresponding one of the pessure chambers.

9. The ink-jet head according to claim 1, wherein each of the recesses is formed through the actuator unit.

10. The ink-jet head according to claim 1, wherein the common electrode is formed into one continuous body in the actuator unit.

11. The ink-jet head according to claim 1, wherein at least one lower piezoelectric sheet includes one or more inactive layers each made of a piezoelectric sheet and disposed between the uppermost piezoelectric sheet and the passage unit.

12. The ink-jet head according to claim 1, wherein all deformable sheets are piezoelectric sheets and at least one of the deformable sheets is an inactive layer that is deformed due to the deformation of the active layer.

13. An ink-jet printer including an ink-jet head, the ink-jet head comprising:

a passage unit including a plurality of pressure chambers each having one end coupled to a nozzle and the other end to be coupled to an ink supply source, the plurality of pressure chambers being arranged in a matrix to neighbor each other; and an actuator unit attached to a surface of the passage unit for changing the volume of each of the pressure chambers, the actuator unit comprising:

a plurality of piezoelectric sheets disposed to continuously extend over the chambers, wherein an uppermost piezoelectric sheet is an active layer that is deformed when an external electric field is applied;

a common electrode disposed on one side of the uppermost piezoelectric sheet and kept at a constant potential;

a plurality of individual electrodes disposed on the other side of the uppermost piezoelectric sheet at positions respectively corresponding to the pressure chambers; and recesses formed in regions of the piezoelectric sheet corresponding to portions between the pressure chambers, wherein the recesses suppress a deformation that propagates in a plane direction of the uppermost piezoelectric sheet.

14. The ink-jet printer according to claim 13, wherein all deformable sheets are piezoelectric sheets and at least one of the deformable sheets is an inactive layer that is deformed due to the deformation of the active layer.

15. An ink-jet head comprising:

a passage unit including a plurality of pressure chambers each having one end coupled to a nozzle and the other end being able to be coupled to an ink supply source, the plurality of pressure chambers being arranged in a matrix to neighbor each other; and an actuator unit attached to a surface of the passage unit for changing the volume of each of the pressure chambers, the actuator unit comprising:

a piezoelectric sheet disposed to continuously extend over the pressure chambers;

a common electrode disposed on one side of the piezoelectric sheet, the common electrode kept at a constant potential;

a plurality of individual electrodes disposed on the other side of the piezoelectric sheet at positions respectively corresponding to the pressure chambers; and recesses formed in regions of the piezoelectric sheet corresponding to portions between the pressure chambers, wherein one or more inactive layers each made of a piezoelectric sheet are disposed between the piezoelectric sheet and the passage unit, and the recesses suppress a deformation that propagates in a plane direction of an uppermost piezoelectric sheet.

16. An ink-jet printer including an ink-jet head, the ink-jet head comprising:

a passage unit including a plurality of pressure chambers each having one end coupled to a nozzle and the other end to be coupled to an ink supply source, the plurality of pressure chambers being arranged in a matrix to neighbor each other; and an actuator unit attached to a surface of the passage unit for changing the volume of each of the pressure chambers, the actuator unit comprising:

a piezoelectric sheet disposed to continuously extend over the pressure chambers;

a common electrode disposed on one side of the piezoelectric sheet and kept at a constant potential;

a plurality of individual electrodes disposed on the other side of the piezoelectric sheet at positions respectively corresponding to the pressure chambers; and recesses formed in regions of the piezoelectric sheet corresponding to portions between the pressure chambers, wherein one or more inactive layers each made of a piezoelectric sheet are disposed between the piezoelectric sheet and the passage unit, and the recesses suppress a deformation that propagates in a plane direction of an uppermost piezoelectric sheet.

17. An ink-jet head comprising:

a passage unit including a plurality of pressure chambers each having one end coupled to a nozzle and the other end being able to be coupled to an ink supply source, the plurality of pressure chambers being arranged in a matrix to neighbor each other; and an actuator unit attached to a surface of the passage unit for changing the volume of each of the pressure chambers, the actuator unit comprising:

a plurality of deformable sheets including one or more piezoelectric sheets disposed to continuously extend over the chambers, wherein an uppermost piezoelectric sheet is an active layer that is deformed when an external electric field is applied;

a common electrode disposed on one side of the uppermost piezoelectric sheet, the common electrode kept at a constant potential;

a plurality of individual electrodes disposed on the other side of the uppermost piezoelectric sheet at positions respectively corresponding to the pressure chambers; and recesses formed in regions of the uppermost piezoelectric sheet corresponding to portions between the pressure chambers, wherein the recesses suppress a deformation that propagates in a plane direction of the uppermost piezoelectric sheet, wherein:

each of the pressure chambers is substantially rhombic and are arranged in a matrix so that sides of the pressure chambers are parallel with each other, each of the individual electrodes have a shape similar to a shape of each of the pressure chambers, each of the recesses is formed so as to substantially enclose the corresponding one of the pressure chambers, each of the recesses is formed along an edge of the corresponding one of the pressure chambers, and each of the recesses is formed so as to correspond to a region other than an acute portion of the corresponding one of the individual electrodes.

* * * * *